US007133012B2

(12) United States Patent
Abe

(10) Patent No.: US 7,133,012 B2
(45) Date of Patent: Nov. 7, 2006

(54) SEMICONDUCTOR DEVICE PROVIDED WITH MATRIX TYPE CURRENT LOAD DRIVING CIRCUITS, AND DRIVING METHOD THEREOF

(75) Inventor: Katsumi Abe, Tokyo (JP)

(73) Assignee: NEC Corporation, Tokyo (JP)

( * ) Notice: Subject to any disclaimer, the term of this patent is extended or adjusted under 35 U.S.C. 154(b) by 292 days.

(21) Appl. No.: 10/501,539

(22) PCT Filed: Jan. 15, 2003

(86) PCT No.: PCT/JP03/00276

§ 371 (c)(1),
(2), (4) Date: Jul. 16, 2004

(87) PCT Pub. No.: WO03/063124

PCT Pub. Date: Jul. 31, 2003

(65) Prior Publication Data

US 2005/0145891 A1 Jul. 7, 2005

(30) Foreign Application Priority Data

Jan. 17, 2002 (JP) ..... 2002-008323

(51) Int. Cl.
*G09G 3/36* (2006.01)

(52) U.S. Cl. ..... 345/90; 345/100

(58) Field of Classification Search ..... 345/84–89, 345/90–100, 103, 204; 257/499; 315/169.1, 315/169.3

See application file for complete search history.

(56) References Cited

U.S. PATENT DOCUMENTS 6,091,203 A 7/2000 Kawashima et al.
6,583,775 B1 6/2003 Sekiya et al.
6,610,251 B1 8/2003 Kanno
6,693,301 B1 2/2004 Takemura
6,873,117 B1 * 3/2005 Ishizuka ..... 315/169.1
2001/0048106 A1 12/2001 Tanada
2002/0079512 A1 * 6/2002 Yamazaki et al. ..... 257/200
2003/0151374 A1 * 8/2003 Maede et al. ..... 315/169.3
2004/0041750 A1 * 3/2004 Abe ..... 345/76

FOREIGN PATENT DOCUMENTS

JP 5-35221 A 2/1993
JP 5-107561 A 4/1993

(Continued)

*Primary Examiner*—Nitin Patel
(74) *Attorney, Agent, or Firm*—Foley & Lardner LLP

(57) ABSTRACT

A semiconductor device to which active drive current programming is applied, comprising current load cells each having a current load and a current load driving circuit, which are arranged in a matrix, capable of reducing the circuit scale of a current driver with little change made in the structure of the current load driving circuit, and a driving method of the same.

A current load cell (113, 114) includes a current load driving circuit which is provided with a transistor (115) connected in series with a current load (122) between first and second power supplies (109, 110); a capacitance (116) connected between the control terminal of the transistor (115) and the first power supply (109); and switches (117, 118) connected between the control terminal of the transistor (115) and a corresponding data line. The output (101) of a current driver is connected to a plurality of data lines via a selector (123, 124), and the plural data lines connected to one output of the current driver via the selector and at least one of the switches of each of the current load cells corresponding to the respective data lines are drive-controlled in a time division manner during one horizontal period.

29 Claims, 16 Drawing Sheets

FOREIGN PATENT DOCUMENTS

| | | | | |
|---|---|---|---|---|
| JP | 6-148680 | A | | 5/1994 |
| JP | 11-109919 | A | | 4/1999 |
| JP | 11-282419 | A | | 10/1999 |
| JP | 2001-60076 | A | | 3/2001 |
| JP | 2001-25900 | A | | 9/2001 |
| JP | 2002-40990 | A | | 2/2002 |
| JP | 2002215095 | | * | 7/2002 |
| JP | 2002-358049 | A | | 12/2002 |
| JP | 2003-195811 | A | | 7/2003 |

* cited by examiner

SEMICONDUCTOR DEVICE PROVIDED WITH MATRIX TYPE CURRENT LOAD DRIVING CIRCUITS, AND DRIVING METHOD THEREOF

TECHNICAL FIELD

The present invention relates to a semiconductor device provided with current loads and current load driving circuits, and a driving method thereof, and more particularly, to a semiconductor device in which current loads and current load driving circuits are arranged in a matrix and an active drive is carried out, and a driving method of the same.

BACKGROUND ART

FIG. 1 is a diagram showing a known structure of a semiconductor device in which current loads are arranged in a matrix. The semiconductor device is finding various applications. In FIG. 1, a semiconductor device 200 comprises a plurality of data lines 202 in a parallel arrangement, a plurality of scanning lines 203 in a parallel arrangement running in a direction perpendicular to the data lines 202, and a matrix of current load cells 201 set at the intersections of the data lines 202 and scanning lines 203, respectively. The data lines 202 are voltage-driven or current-driven by a voltage driver or a current driver 230. The scanning lines 203 are driven by a scanning circuit 240. Examples of the semiconductor device include an organic EL (Electro Luminescence) display device in which organic EL elements being current loads are used as the current load cells 201.

There are two main driving methods for the semiconductor device, in which the current loads are arranged in a matrix, as follows:

(1) passive drive by which the lines are selected one by one, and the loads are driven only for a selected period of time; and (2) active drive by which the lines are selected one by one, the value of current is memorized by memorizing information for driving the loads during a selected period of time, that is, a voltage corresponding to the value of current fed to each current load, and thereby the loads are driven with the memorized current value until next time the same line is selected.

A passive driving device is formed of current loads. For example, as shown in FIG. 2 (*a*), the current load cells 201, which are arranged in a matrix, may be realized from a simple structure with only a plurality of the data lines 202, a plurality of the scanning lines 203, and current loads 206 each being connected between the respective data lines 202 and scanning lines 203. In the passive driving device, however, since the loads are driven only for a selected period of time, a large current flow is required. Consequently, in the case of the passive driving device, the current loads 206 take heavy loads instantaneously, which may cause a problem with the reliability of elements that form the current loads 206. Moreover, the passive driving device consumes a measurable amount of power because of a drop in efficiency.

On the other hand, in an active driving device, the current load cells 201, which are arranged in a matrix, includes a plurality of the data lines 202, a plurality of the scanning lines 203, the current loads 206, and current load driving circuits 207 each of which is connected with the current load 206 between the data line 202 and the scanning line 203 for memorizing a voltage corresponding to the value of current fed to each current load 206 to drive the load as shown in FIG. 2 (*b*).

The current load driving circuit 207 in the respective current load cells 201 is made of a transistor or the like. The current load cell 201 has a complex structure as compared to that of the passive driving device. Nevertheless, the active driving device requires a small load driving current and the load on the current loads is reduced since they are driven for a long period of time from when a line is selected to when next time the same line is selected after all lines are selected. In addition, the active driving device consumes lower amounts of power because of its high efficiency. For the reasons mentioned above, the active drive may be superior to the passive drive in the load on the current loads and electric power consumption.

The structure of the current load driving circuit 207 for the active drive is broadly classified into two types: in one type (referred to as "voltage write-in structure"), a voltage to be applied by a semiconductor device (voltage driver 230 in FIG. 1) that feeds the respective current load driving circuits with voltage is memorized, and the respective loads are driven by a current corresponding to the voltage memorized; and in another type (referred to as "electric current programming structure"), current is applied by a semiconductor device (voltage driver 230 in FIG. 1) that feeds the respective current load driving circuits 207 with current, a voltage corresponding to the current is memorized, and the loads are driven by a current corresponding to the current.

Taking an organic EL display device as an example, it is often the case that current is memorized in an organic EL element of each picture element or pixel, and the current load driving circuits are formed of polysilicon Thin Film Transistors (abbreviated to "p-Si TFT"). Incidentally, since the p-Si TFT (obtained by low-temperature p-Si process) has high field effect mobility, it is possible to integrate parts of peripheral circuits or drivers with the display substrate, which enables high-speed and large-current switching control.

There has been disclosed in Japanese Patent Application laid open No. HEI5-107561 the voltage write-in structure as shown in FIG. 3 (see FIG. 7 of the Patent Application). A one-pixel display section 210 comprises: a light emitting element 220 whose one end (anode terminal) is connected to a power supply line 204; a TFT (Thin Film Transistor) 211 formed of polysilicon n-channel MOSFET, whose drain is connected to the other end (cathode terminal) of the light emitting element 220, and whose source is connected to a ground line 205; a hold capacitance 212 connected between the gate of the TFT 211 and the ground line 205; and a switch 213 placed between the gate of the TFT 211 and a data line 202. A control line K 215 is connected to the control terminal of the switch 213, and ON/OFF control is carried out based on a control signal K 215 transmitted through the control line K 215 (hereinafter a control line and a signal transmitted on the control line will be designated by the like reference numeral). When the control signal K 215 becomes active and the switch 213 is turned on, the hold capacitance 212 is charged by the voltage of the data line 202. At the same time, the voltage of the data line 202 is applied to the TFT 211 as a gate voltage, thereby turning on the TFT 211. Consequently, the current path of the power supply line 204, the light emitting element 220 and the ground line 205 is allowed to conduct, and the light emitting element emits light. The brightness or luminance of the light emitting element 220 is changed according to the gate voltage of the TFT 211.

However, with the p-Si TFT, there are considerable variations in the current capacity of respective transistors, and therefore, it is highly likely that the driving current differs between TFTs even when the same voltage is used. In this case, variations are produced in the brightness of the organic EL elements, and display accuracy deteriorates.

In order to solve the problem, there has been proposed, for example, in Japanese Patent Application laid open No. HEI11-282419 the electric current programming structure as shown in FIG. 4 (see FIG. 1 of the Patent Application). With this structure, effects are produced only by relatively small variations in the current capacity of TFTs in adjacent areas, and high-precision display can be achieved.

Referring to FIG. 4, in this circuit, one terminal of the switch 213 in FIG. 3, not the one being connected to the gate of the TFT 211, is connected to the gate of the TFT 216 (current conversion element) formed of polysilicon n-channel MOSFET, whose gate and drain are connected (i.e. diode-connected) to each other and whose source is connected to the ground line 205. Besides, the drain of the TFT 216 is connected to the data line 202 through the switch 214, and the control terminals of both the switches 213 and 214 are connected to the control line K 215. The control signal for controlling the brightness of the organic EL element is fed to the data line as a variable control current. The TFT 216 converts the current input into a voltage via the switch 214.

However, a current driver employed for the electric current programming structure needs an output circuit for supplying current to respective data lines so that it can simultaneously supply current to the respective current load driving circuits on the selected line through the data lines during a one-line selection period. Consequently, it is necessary to provide the current drivers as many as all the data lines, which drives up costs.

In addition, there is another problem in that contact points between the current drivers and a device having current load cells for active drive arranged in a matrix increase, which reduces reliability and productivity.

Furthermore, it has been considered to form the voltage drivers or current drivers with the p-Si TFT as well as a matrix of organic EL elements and current load driving circuits on the same substrate so as to reduce the number of parts and costs. In this case, however, yields, reliability and productivity decrease because the device as a whole increases in circuit size or scale as the circuit scale of current driver part becomes larger.

PROBLEMS THAT THE INVENTION IS TO SOLVE

As described above, conventional devices and driving methods have problems as follows.

The first problem is that, in a semiconductor device to which active drive current programming is applied, comprising a matrix of current loads and current load driving circuits, the cost of current drivers increases, and there is a difficulty in improving productivity and reliability.

This is because there is a need for outputs in the number of data lines of the device comprising a matrix of the current loads and current load driving circuits, and therefore, a plurality of current drivers are required, which increases the number of parts.

The second problem is that, in a semiconductor device to which active drive current programming is applied, comprising a matrix of current loads and current load driving circuits, in the case where the semiconductor device is provided with built-in current drivers, costs increase, and there is a difficulty in improving productivity and reliability.

This is because it is necessary to feed all data lines of the device comprising a matrix of the current loads and current load driving circuits with current supply outputs from the current drivers, and therefore, the circuit scale of the current drivers becomes larger and the device as a whole increases in circuit size or scale, which drives yields down.

It is therefore an object of the present invention to provide a semiconductor device to which active drive current programming is applied, comprising current load cells each having a current load and a current load driving circuit, which are arranged in a matrix, capable of reducing the circuit scale of a current driver with little change made in the structure of the current load driving circuit, and a driving method of the same.

DISCLOSURE OF THE INVENTION

In accordance with the first aspect of the present invention, to achieve the object mentioned above, there is provided a semiconductor device that performs active drive current programming, comprising: current load cells each having a current load and a current load driving circuit, which are arranged in a matrix; and a means for selecting a plurality of data lines one by one with respect to one current output from a current driver for supplying current to the respective data lines, and supplying the current output to the selected data line; wherein the current load driving circuit in each of the current load cells includes a transistor whose source is connected to a first power supply while whose drain is connected to the current load directly or via a switch for supplying current to the current load, a capacitance connected between the gate of the transistor and the first power supply or another power supply, and a switch or a plurality of series-connected switches connected between the gate of the transistor and a corresponding data line; and there are control lines, each of which transmits a signal for controlling the switch connected to the gate of the transistor included in the current load driving circuit, at least as many as data lines selectable by one current output of the current driver in one line of the semiconductor device.

In accordance with another aspect of the present invention, there is provided a semiconductor device that performs active drive current programming, comprising: current load cells each having a current load and a current load driving circuit, which are arranged in a matrix; and a means for selecting a plurality of data lines one by one with respect to one current output from a current driver for supplying current to the respective data lines, and supplying the current output to the selected data line; wherein the current load driving circuit in each of the current load cells includes a transistor whose source is connected to a first power supply while whose drain is connected to the current load directly or via a switch for supplying current to the current load, a capacitance connected between the gate of the transistor and the first power supply or another power supply, and a plurality of switches connected in series between the gate of the transistor and a corresponding data line; there are control lines, each of which transmits a signal for controlling the switch whose one end is connected to the gate of the transistor included in the current load driving circuit, at least as many as data lines selectable by one current output of the current driver in one line of the semiconductor device; and there are control lines, each of which transmits a signal for controlling the switch whose one end is connected to the data line corresponding to the current load cell having the current load driving circuit, in each line of the semiconductor device.

In the semiconductor device according to the present invention, the plural data lines are selected one by one with respect to one current output from the current driver during a one-line selection period (one horizontal period), and, on the occasion when each data line is selected, current corresponding to that for driving the current load in the respective current load cells is supplied to the current load driving circuit on the selected line and also on the selected data line.

In accordance with yet another aspect of the present invention, there is provided a method for driving a semiconductor device that performs active drive current programming and comprises current load cells each having a current load and a current load driving circuit, which are arranged in a matrix, wherein: the output of a current driver for current-driving data lines is input in a selector; the selector selects the plural data lines connected respectively to the outputs of the selector one by one based on an output select signal input therein; the output of the current driver is supplied to the selected data line; the current load driving circuit in each of the current load cells includes a transistor whose source is connected to a first power supply while whose drain is connected to the current load directly or via a switch for supplying current to the current load, a capacitance connected between the gate of the transistor and the first power supply or another power supply, and a switch or a plurality of series-connected switches connected between the gate of the transistor and a corresponding data line; and there are control lines, each of which transmits a signal for controlling the switch in the current load driving circuit, at least as many as data lines selectable by one current output of the current driver in one line of the semiconductor device; comprising: a first step for passing current corresponding to the current output supplied from the current driver to the selected data line through the transistor in the current load cell, and setting a voltage that causes the current to flow in the gate of the transistor and the capacitance by turning on the switch whose one end is connected to the gate of the transistor in the current load cell with a control signal transmitted through one of the plural control lines corresponding to the selected data line during the period while the selector selects one of the plural data lines based on the output select signal in one horizontal period for selecting one line; and a second step for turning off the switch before or upon completion of the select period for the selected data line; wherein the first and second steps are performed with respect to each of the plural data lines to complete current programming for the current load cells corresponding to one line.

In accordance with yet another aspect of the present invention, there is provided a method for driving a semiconductor device that performs active drive current programming, and comprises: current load cells each having a current load and a current load driving circuit, which are arranged in a matrix; and a means for selecting a plurality of data lines one by one to supply the current output of a current driver for supplying current to the respective data lines; wherein: the current load driving circuit in each of the current load cells includes a transistor whose source is connected to a first power supply while whose drain is connected to the current load directly or via a switch for supplying current to the current load, a capacitance connected between the gate of the transistor and the first power supply or another power supply, and a plurality of switches connected in series between the gate of the transistor and a corresponding data line; there are control lines, each of which transmits a signal for controlling the switch whose one end is connected to the gate of the transistor included in the current load driving circuit, at least as many as data lines selectable for one output of the current driver in one line of the semiconductor device; and there are control lines, each of which transmits a signal for controlling the switch whose one end is connected to the data line corresponding to the current load cell having the current load driving circuit, in each line of the semiconductor device; comprising: a first step for setting the respective switches whose one ends are connected to the data lines corresponding to the current load cells for one line to the on state during one horizontal period with a control signal transmitted through the control line provided to each line in one horizontal period for selecting one line; a second step for passing current corresponding to the current output supplied from the current driver to the selected data line through the transistor in the current load cell, and setting a voltage that causes the current to flow in the gate of the transistor and the capacitance by turning on the switch whose one end is connected to the gate of the transistor in the current load cell with a control signal transmitted through one of the plural control lines corresponding to the selected data line during the period while the selector selects one of the plural data lines based on the output select signal; and a third step for turning off the switch before or upon completion of the select period for the selected data line; wherein the second and third steps are performed with respect to each of the plural data lines to complete current programming for the current load cells corresponding to one line.

Figure 1:
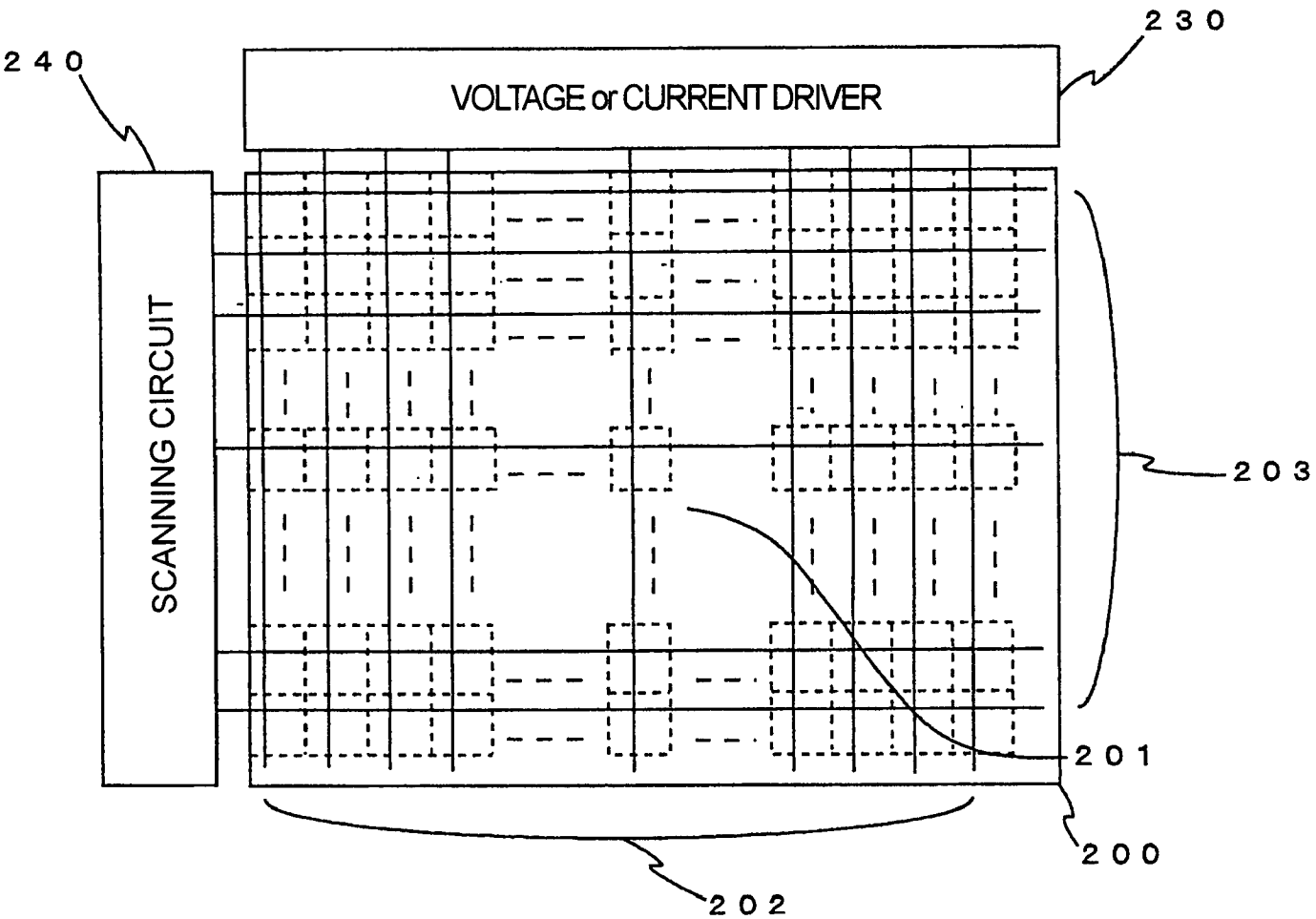
FIG. 1 is a diagram showing a semiconductor device in which current load cells are arranged in a matrix.
Figure 2:
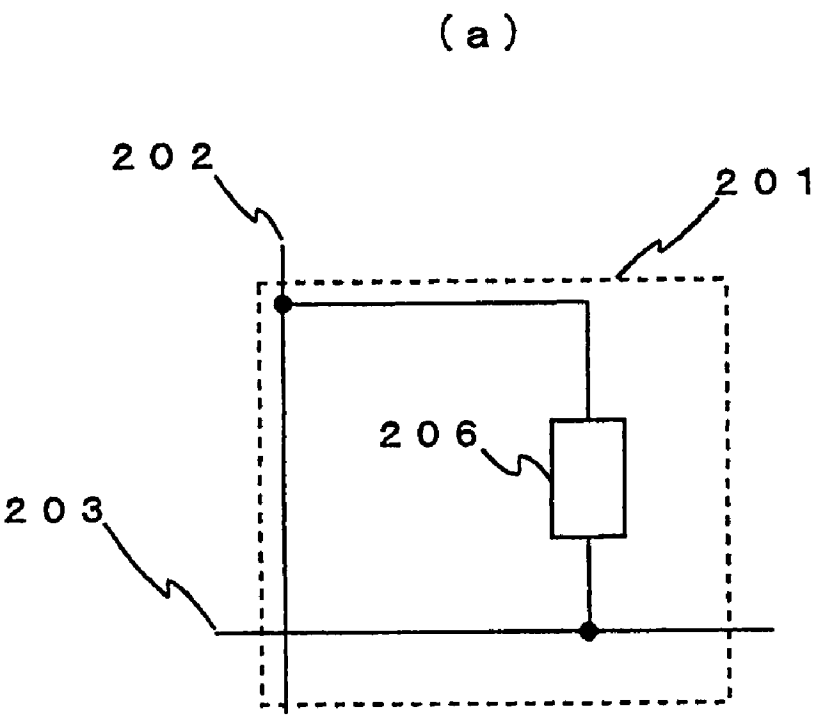
FIG. 2 is a diagram showing the configuration of the current load cell: (a) for passive drive, and (b) for active drive.
Figure 2:
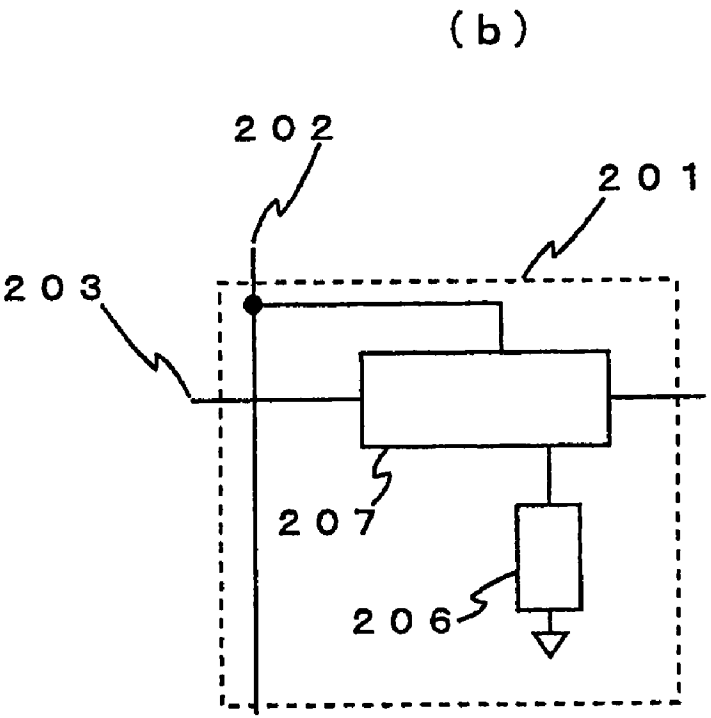
Figure 3:
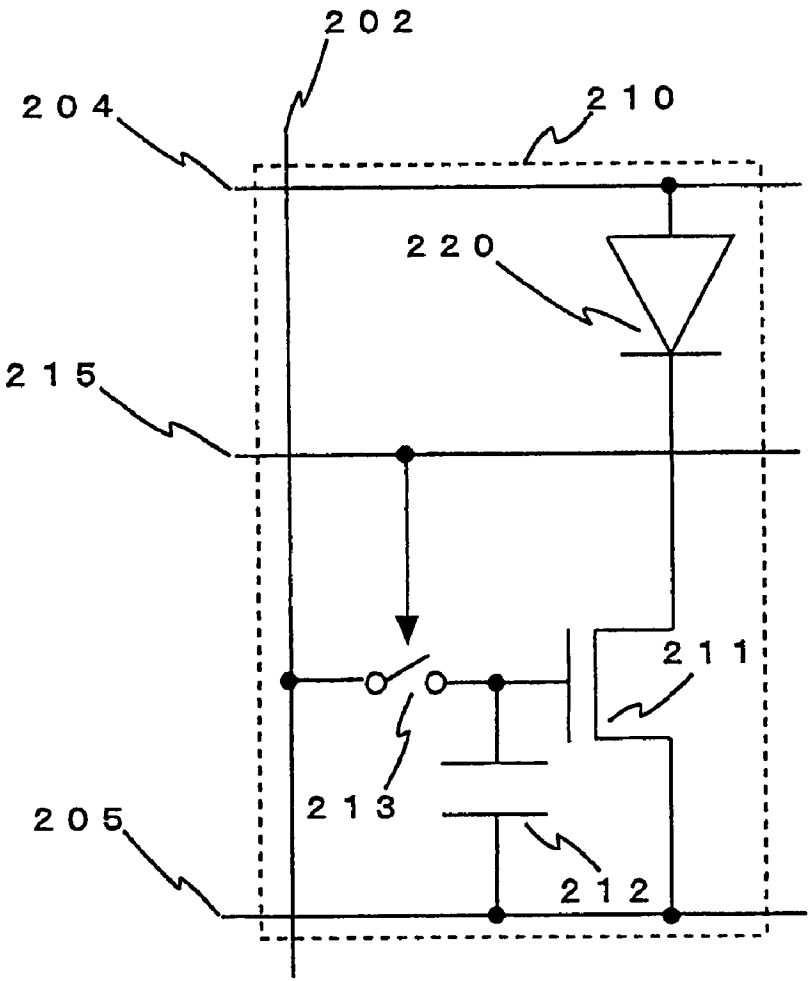
FIG. 3 is a diagram showing the conventional circuitry of an active-drive voltage write pixel circuit.
Figure 4:
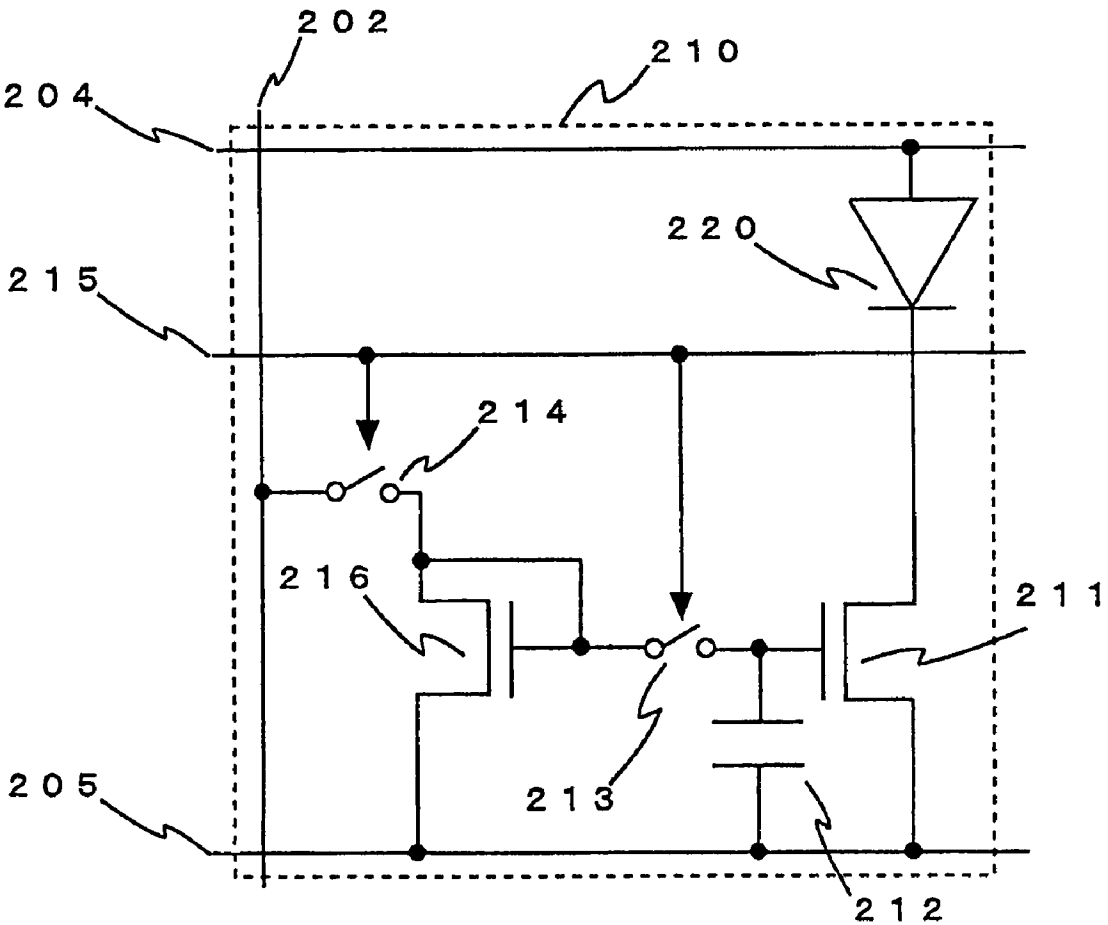
FIG. 4 is a diagram showing the conventional circuitry of an active-drive current programming pixel circuit.

Incidentally, the reference numeral 101 represents current driver one output. The reference numeral 102 represents a first data line (data line 1). The reference numeral 103 represents a second data line (data line 2). The reference numeral 104 represents a control line K. The reference numeral 105 represents a first control line KA. The reference numeral 106 represents a second control line KB. The reference numeral 107 represents a third control line KC. The reference numeral 108 represents a fourth control line KD. The reference numeral 109 represents a power supply line. The reference numeral 110 represents a ground line. The reference numeral 111 represents a first output select signal (output select signal 1). The-reference numeral 112 represents a second output select signal (output select signal 2). The reference numeral 113 represents a first pixel (pixel 1). The reference numeral 114 represents a second pixel (pixel 2). The reference numeral 115 represents a first TFT (TFT 1). The reference numeral 116 represents a capacitance. The reference numeral 117 represents a first switch (SW 1). The reference numeral 118 represents a second switch (SW 2). The reference numeral 119 represents a second TFT (TFT 2). The reference numeral 120 represents a third switch (SW 3). The reference numeral 121 represents a fourth switch (SW 4). The reference numeral 122 represents a light emitting element. The reference numeral 123 represents a first selector switch (SEL 1). The reference numeral 124 represents a second selector switch (SEL 2). The reference numeral 200 represents a semiconductor device. The reference numeral 201 represents a current load cell. The reference numeral 202 represents data line. The reference numeral 203 represents a scanning line. The reference numeral 204 represents a power supply line. The reference numeral 205 represents a ground line. The reference numeral 206 represents a current load. The reference numeral 207 represents a current load driving circuit. The reference numeral 210 represents a pixel section. The reference numeral 211 represents a first TFT (TFT 1). The reference numeral 212 represents a capacitance. The reference numeral 213 represents a first switch (SW 1). The reference numeral 214 represents a second switch (SW 2). The reference numeral 215 represents a control line K. The reference numeral 216 represents a second TFT (TFT 2). The reference numeral 220 represents a light emitting element. The reference numeral 230 represents a voltage driver (current driver). The reference numeral 240 represents a scanning circuit.

BEST MODE FOR CARRYING OUT THE INVENTION

A description will be given of embodiments of the present invention. In accordance with a preferred embodiment of the present invention, a semiconductor device to which active drive current programming is applied, comprising current load cells each having a current load and a current load driving circuit, which are arranged in a matrix, wherein: a selector (the selector comprised of selector switches 123 and 124 in FIG. 5) selects a plurality of data lines one by one with respect to each current output (101 in FIG. 5) from a current driver for supplying current to the respective data lines; the current load driving circuit in each of the current load cells includes a transistor (115 in FIG. 5) whose source is connected to a first power supply (109 in FIG. 5) while whose drain is connected to the current load (122 in FIG. 5) directly or via a switch (switch SW 3 in FIG. 11) for supplying the current load (122) with current corresponding to the current output from the current driver fed to the respective data lines via the selector, a capacitance (116) whose one end is connected to the gate of the transistor (115) while the other end is connected to the first power supply (109), and a switch or a plurality of series-connected switches (117 and 118 in FIG. 5) connected between the gate of the transistor (115) and a corresponding data line; and there are control lines (105 and 106), which transmit signals for controlling the switches (117 and 118), at least as many as data lines which are selectable by the selector (123 and 124) for one current output (101) of the current driver in one line of the semiconductor device. Incidentally, the capacitance (116) may be connected between the gate of the transistor (115) and another power supply such as a second power supply (110).

In the semiconductor device according to the present invention, with respect to one current output (101) of the current driver, the selector (123 and 124) selects the plural data lines one by one during one horizontal period based on an output select signal input therein. On the occasion when each data line is selected, current corresponding to that for driving the current load in the respective current load cells is supplied to the current load driving circuit of the current load cell on the selected line and also on the selected data line.

In accordance with the present invention, one output of the current driver drives the plural data lines and the current load driving circuits corresponding thereto in a time division manner. By virtue of this construction, it is possible to reduce the number of necessary outputs from the current driver. Consequently, the number of current drivers can be reduced, which enables cost reductions as well as enhancement of productivity and reliability. Moreover, since the plural data lines are driven by the same output of the current driver, the current of outputs from the current driver varies less as a whole.

Besides, under the method for driving a semiconductor device according to an embodiment of the present invention, when an appropriate data line is selected during one horizontal period, in the current load driving circuit on the selected line and also on the selected data line, the one or plural series-connected switches, whose one end is connected to the gate of the transistor, is/are turned on based on a control signal transmitted through the corresponding control line. In addition, a voltage corresponding to the current fed through the data line and the switch is set in the gate of the transistor and one end of the capacitance, and thereby the transistor memorizes a current value. After that, the one or plural series-connected switches, whose one end is connected to the gate of the transistor, is/are turned off through the corresponding control line before or at the completion of selection of the data lines.

A different data line is continuously selected, and the current load driving circuit on the selected line and also on the selected data line controls the one or plural series-connected switches, whose one end is connected to the gate of the transistor, by a control signal transmitted through the different control line than the previous one, which corresponds to the selected data line. This operation is repeated, and at the time all the data lines have been selected, one horizontal period ends. The transistor drives the current load according to the current memorized therein.

By repeating such one horizontal period for all the lines, the current load driving circuits drive all the current loads, which are arranged in a matrix, respectively. The repetition of the above operation enables all the current loads to be always driven by the proper current.

In accordance with the present invention, the semiconductor device may be provided with control lines, each of which transmits a signal for controlling the switch (SW 1 (117)) whose one end is connected to the gate of the transistor (115) in the current load driving circuit of each current load cell, at least as many as data lines (102 and 103) selectable by the selector (123 and 124) for one current output (101) from the current driver of the semiconductor device; and a control line, which transmits a signal for controlling the switch (SW 2 (118)) and whose one end is connected to the corresponding data line in the current load driving circuit, with respect to each line. In other words, a plurality of the current load cells in one line may share the control line, which transmits a signal for controlling the switch (SW 2 (118)) and whose one end is connected to the corresponding data line in each of the current load driving circuits.

According to an embodiment of the present invention, in the semiconductor device to which active drive current programming is applied, comprising a matrix of the current load cells each having the current load and current load driving circuit, the plural data lines and the current load driving circuits corresponding thereto can be driven in a time division manner with one output from the built-in current driver. Consequently, it is possible to reduce the number of necessary outputs from the current driver. Thereby, the scale or size of a circuit can be reduced, which enables a cost reduction as well as an increase in yield, productivity and reliability. Moreover, since the plural data lines are driven by the same output of the current driver, the current varies less according to outputs from the current driver on the whole.

[Embodiments]

Referring now to the drawings, a description of the aforementioned embodiment of the present invention will be given in more detail. In the following, a light emitting display device using light emitting elements as the current loads will be described. Hereinafter, the current load cell will be referred to as a pixel, and the current load driving circuit will be referred to as a light emitting element driving circuit. However, the light emitting element is cited merely by way of example and without limitation. The present invention is applicable for driving any current load including specific one such as the organic EL element.

Figure 5:
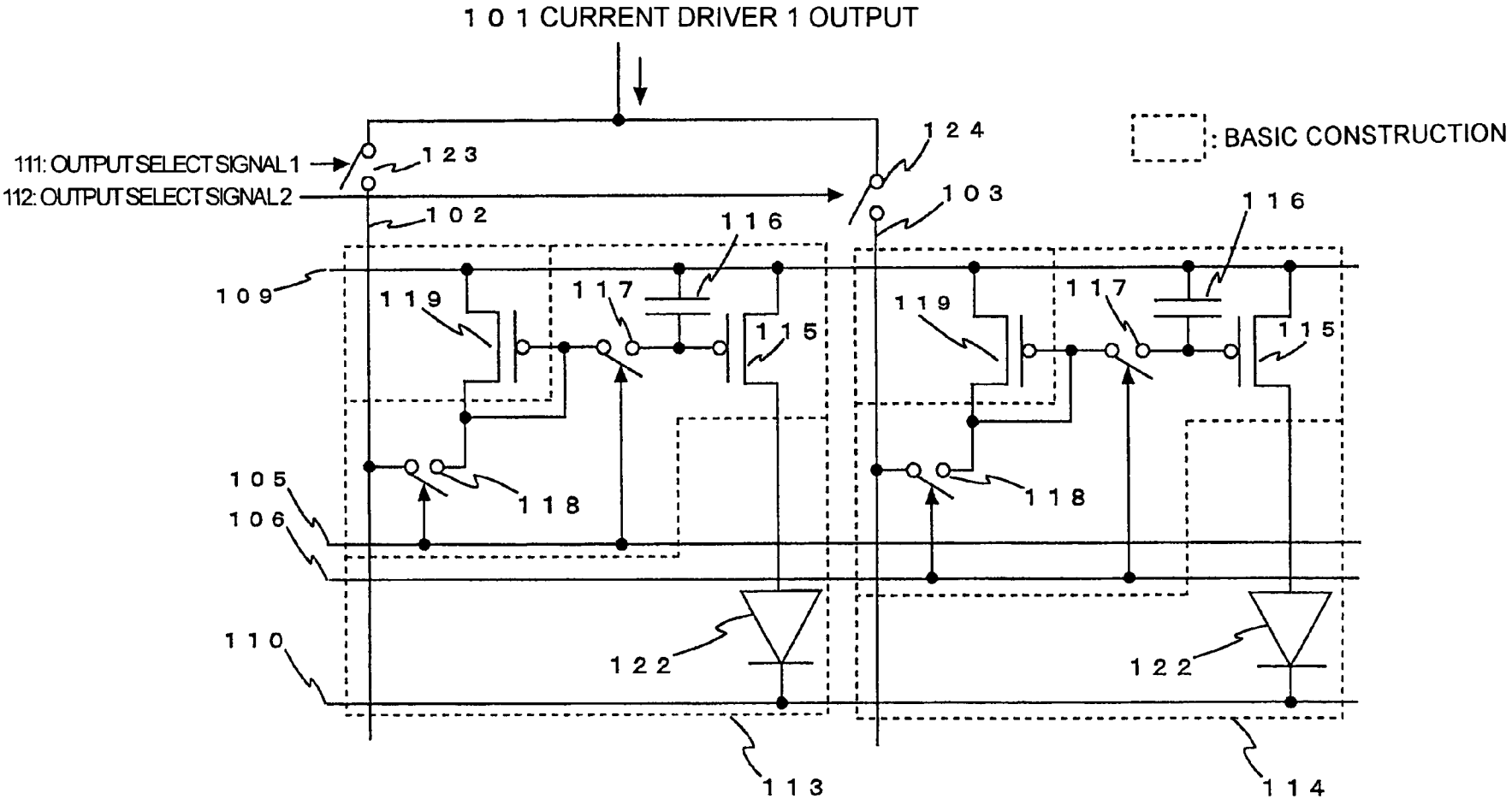
FIG. 5 is a diagram showing a circuitry according to the first embodiment of the present invention.

FIG. 5 is a diagram showing a circuitry according to the first embodiment of the present invention. Incidentally, while, in a schematic view of FIG. 5, one of the two data lines 102 and 103 is selected by the selector for one output 101 from the current driver, two or more data lines may be selected in the case, for example, where the driving time can be reduced. Besides, FIG. 5 shows only two pixel circuits (pixels 1 and 2), and data lines 102 and 103 to which the output of the same current driver branches, however, the light emitting display device includes such cells which are arranged in a matrix therein as shown in FIG. 1.

In this embodiment, looking at the first pixel 113 (also referred to as "pixel 1"), the driving circuit for driving the light emitting element 122 in the pixel comprises: the first TFT (Thin Film Transistor) 115 (also referred to as "TFT 1") formed of polysilicon p-channel MOSFET, whose source is connected to the power supply 109 and whose drain is connected to one end of the light emitting element 122, for supplying current to the light emitting element 122; the capacitance 116 whose one end is connected to the gate of the first TFT 115 while the other end is connected to the power supply line 109; the first switch 117 (also referred to as "SW 1") connected between the gate of the second TFT 119 (also referred to as "TFT 2"), whose source is connected to the power supply line 109 and whose gate and drain are connected (i.e. diode-connected) to each other, and a contact node between the gate of the first TFT 115 and the capacitance 116; and the second switch 118 (also referred to as "SW 2") placed between the drain of the second TFT 119 and the first data line 102 (also referred to as "data line 1"); wherein the control terminals of both the first and second switches 117 and 118 are connected to the control line KA for transmitting the control signal KA.

In the second pixel 114 (also referred to as "pixel 2"), the drain of the second TFT 119 is connected to the second data line 103 (also referred to as "data line 2") through the second switch 118, and the control terminal of the second switch 118 is connected to the control line KB for transmitting the second control signal KB. The second pixel 114 is of essentially the same construction as the first pixel 113 except for the connected data line and control line. Incidentally, in this and the following embodiments, one end of the capacitance 116 in each pixel is connected to the gate of the first TFT 115, however, the other end may be connected to a power supply other than the power supply line 109, such as the ground line 110 or other arbitrary power supplies.

The output 101 of the current driver (see current driver 230 in FIG. 1) is connected to the first and second data lines 102 and 103 via the first and second switches 123 and 124 (also referred to as "SEL 1 and SEL 2") which are controlled to be on/off based on the first and second output select signals 111 and 112 (also referred to as "output select signal 1 and output select signal 2") input into their control terminals, respectively.

As is described above, each of the pixels 113 and 114 is composed of: the TFT 115 for driving the light emitting element 122; the capacitance 116; and the series-connected first and second switches (SW 1 and SW 2), which are controlled according to the control signal KA transmitted through the first control line KA (105) or the control signal KB transmitted through the second control line KB (106), and placed between the data line and the gate of the TFT 115 as a drive means; as a basic construction (a block indicated by broken lines in FIG. 5). In addition, each of the pixels 113 and 114 further includes: the second TFT 119, whose source is connected to the power supply 109 and whose gate and drain are shorted to one another, connected between the first and second switches 117 and 118 (the first and second TFTs 115 and 119 form a current mirror); the power supply line 109; and the ground line 110. Besides, one end of the light emitting element 122 in each pixel is connected to the drain of the first TFT 115, while the other end is connected to the ground line 110.

In accordance with this embodiment, differently from the aforementioned Japanese Patent Application laid open No. HEI11-282419, the two pixels 113 and 114 are provided with the different control lines KA 105 and KB 106, respectively, for controlling the first and second switches 117 and 118 in the pixels. Further, the pixels 113 and 114 are provided with the switches 123 and 124 controlled by the first and second output select signals 111 and 112, respectively, for selecting either the first data line 102 or the second data line 103 to input one output of the current driver to each of the two pixels as shown in FIG. 5. Incidentally, while the two selector switches 123 and 124 are employed as the selector for allocating the current driver output to the data line 1 or the data line 2 based on the output select signals 1 and 2 in this embodiment, the construction of the selector is not so limited. As a one-input and multiple-output selector, any construction may be applicable to the selector. Additionally, in the following description, the switch is on when the control signal for the ON/OFF control input into the control terminal of the switch is at a high level while the switch is in off when the control signal is at a low level.

Figure 6:
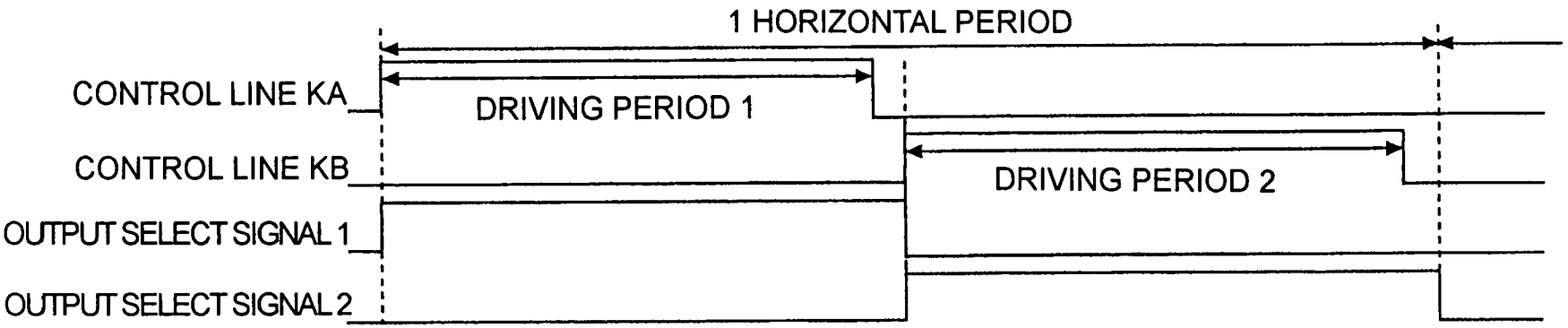
FIG. 6 is a chart showing the timing operation according to the first embodiment of the present invention.

FIG. 6 is a timing chart for explaining the operation according to the first embodiment of the present invention. In FIG. 6, the control signals KA (105) and KB (106) correspond to the signals transmitted through the control lines 105 and 106 of FIG. 5, respectively, and the output select signals 1 and 2 correspond to those denoted by reference numerals 111 and 112 in FIG. 5. During the driving period 1 in the former part of one horizontal period, the control signal KA (105) is active while the control signal KB (106) is active during the driving period 2 in the latter part of one horizontal period. Besides, the output select signal 1 is active in the former part of one horizontal period, and inactive in the latter part. On the other hand, the output select signal 2 is inactive in the former part of one horizontal period, and active in the latter part.

Figure 7:
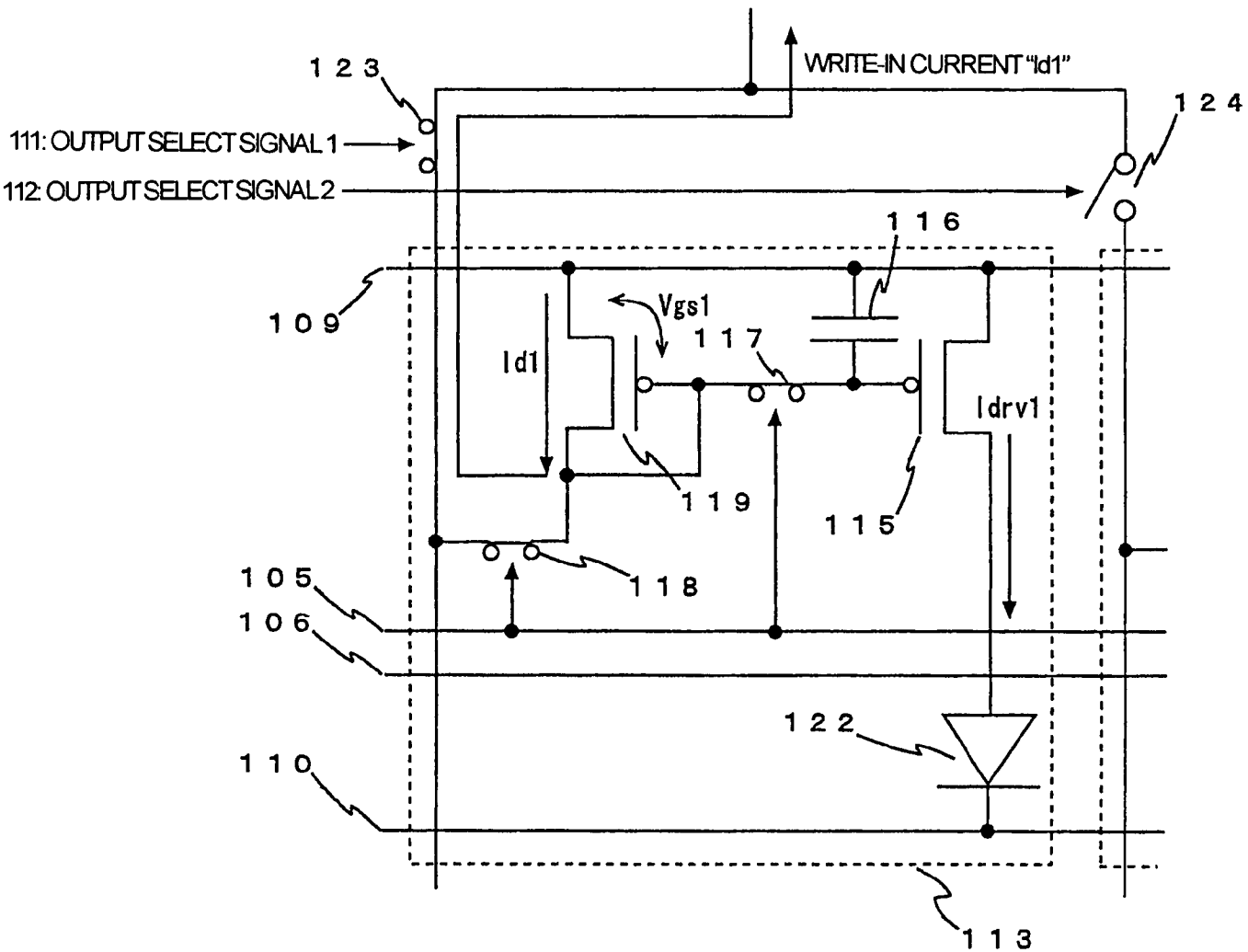
FIG. 7 is a diagram showing the operating state in a driving period 1 according to the first embodiment of the present invention.

One horizontal period is a period for supplying current to pixels in one line of a matrix of pixels and memorizing the current therein. FIG. 7 shows the pixel 1 during the driving period 1 in one horizontal period (see FIG. 6). FIG. 7 is a diagram for explaining the circuit operation of the first pixel 113 in FIG. 5 during the driving period 1 (see FIG. 6). Incidentally, it is apparent that respective component parts shown in FIG. 7 correspond to those in FIG. 5.

In the driving period 1 shown in FIG. 6, the control signal KA (105) and the output select signal 1 are at a H (high) level while the control signal KB (106) and the output select signal 2 are at a L (low) level, and the SW 1, SW 2 and SEL 1 of the pixel 1 are on while the SW 1, SW 2 and SEL 2 of the pixel 2 are off. Consequently, by the output of the current driver, current Id1 corresponding to the current to be supplied to the light emitting element of the pixel 1 through the TFT 1 of the pixel 1 is supplied via the data line 1 and SW 1 of the pixel 1 to the second thin film transistor TFT 2 of the pixel 1, which operates in the saturation region because the drain and the gate thereof are short-circuited.

When the operation of the TFT 2 in the pixel 1 becomes stable, the gate/drain voltage of the TFT 2 in the pixel 1 is such voltage as to cause the flow of current Id1 through the TFT 2 of the pixel 1. This voltage is stored in the capacitance 116 through the SW 2 of the pixel 1, and applied to the gate of the TFT 1 in the pixel 1. On this occasion, gate-source voltage Vgs1 for the TFT 1 in the pixel 1 is determined, and current Idrv1 according to the voltage-current characteristics of the TFT 1 in the pixel 1 is supplied to the light emitting element 122 of the pixel 1. Thereby, the light emitting element 122 of the pixel 1 emits light with brightness determined by the current.

At the end of the driving period 1, the control signal KA (105) is at an L level, and only the SW 1 and SW 2 of the pixel 1 are off. The other control signal remains the same as in the driving period 1. However, the output select signal 1 may mark an L level at the same time as the control signal KA (105). In this case, the selector SEL 1 is turned off at the same time as the switch SW 1 of the pixel 1.

During the driving period 2 in one horizontal period, the control signal KA (105) and the output select signal 1 are at an L level while the control signal KB (106) and the output select signal 2 are at an H level, and the SW 1, SW 2 and SEL 1 of the pixel 1 are off, and the SW 1, SW 2 and SEL 2 of the pixel 2 are off. Consequently, in the pixel 2 during the driving period 1, by the output of the current driver, current Id2 corresponding to the current to be supplied to the light emitting element 122 of the pixel 2 through the TFT 1 of the pixel 2 is supplied via the data line and SW 1 of the pixel 2 to the TFT 2 of the pixel 2, which operates in the saturation region because the drain and the gate thereof are short-circuited as in the case of the pixel 1 in the driving period 1. When the operation of the TFT 2 in the pixel 2 becomes stable, the gate/drain voltage of the TFT 2 in the pixel 2 is such voltage as to cause the flow of current Id2 through the TFT 2 of the pixel 2. This voltage is stored in the capacitance 116 through the SW 2 of the pixel 2, and applied to the gate of the TFT 1 in the pixel 2. On this occasion, the gate-source voltage of the TFT 1 in the pixel 2 is determined, and the current according to the voltage-current characteristics of the TFT 1 in the pixel 2 is supplied to the light emitting element of the pixel 2. Thereby, the light emitting element of the pixel 2 emits light with brightness determined by the current.

Figure 8:
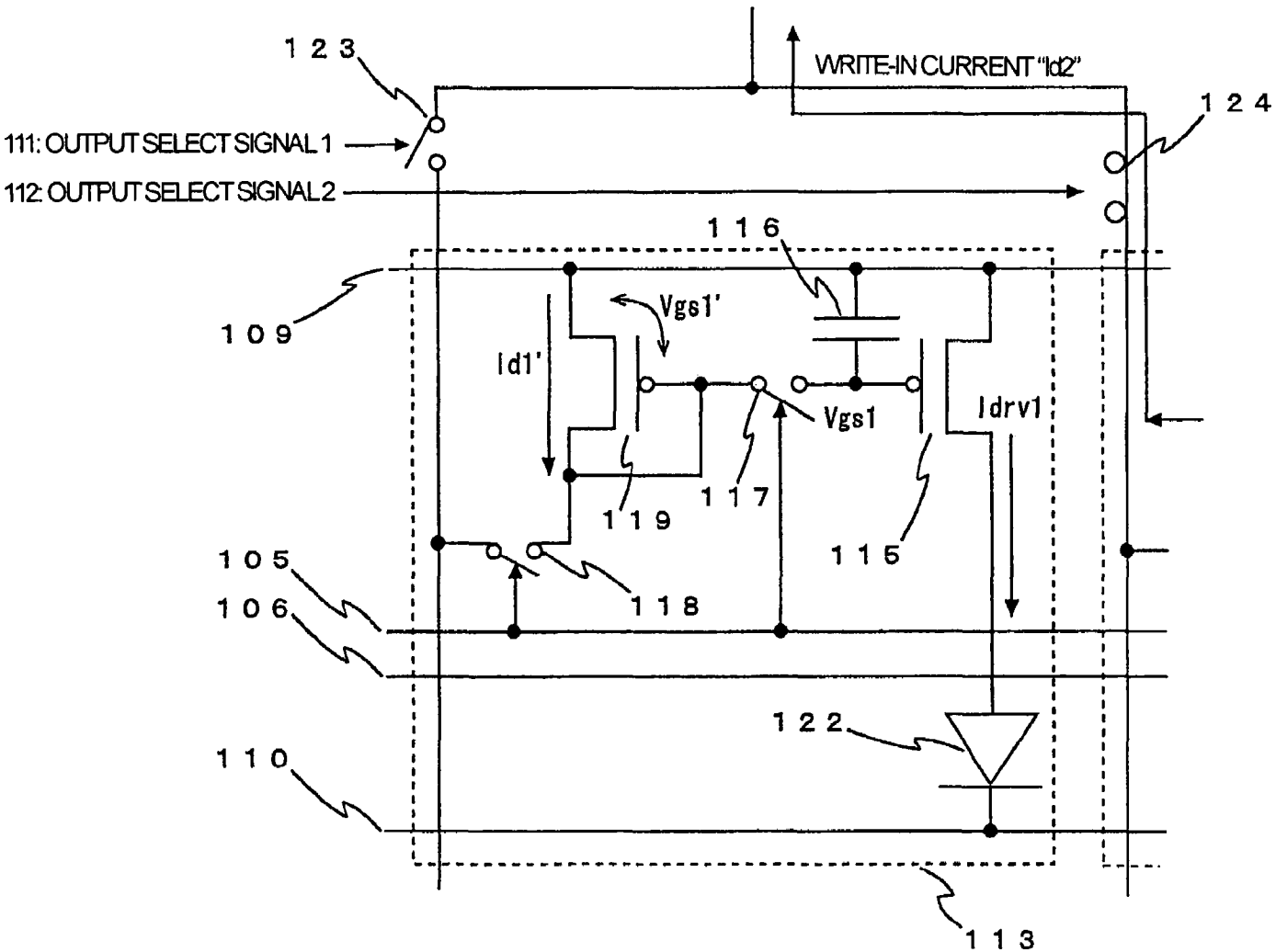
FIG. 8 is a diagram showing the operating state in a driving period 2 according to the first embodiment of the present invention.

FIG. 8 is a diagram for describing the pixel 1 during the driving period 2 shown in FIG. 6. In the driving period 2, the SW 1 and SW 2 of the pixel 1 are off. At this time, since the gate and drain of the TFT 2 in the pixel 1 are short-circuited, a current flows between the drain and the source until the gate voltage of the TFT 2 becomes almost a threshold voltage of the TFT 2. On the other hand, the gate voltage of the TFT 1 in the pixel 1 remains the voltage Vgs1, which has been determined in the driving period 1, because the SW 2 of the pixel 1 is off.

At the end of the driving period 2, as with the driving period 1, the control signal KB (106) is at an L level, and only the SW 1 and SW 2 of the pixel 2 have been changed to off. The other control line remains the same as in the driving period 2. However, the output select signal 2 may mark an L level at the same time as the control signal KB (106). In this case, the selector SEL 2 is turned off at the same time as the SW 1 of the pixel 2.

The operation described above is performed in one horizontal period. When all the lines undergo such one horizontal period, the driving of one frame corresponding to one image plane or screen is completed. The light emitting display device of the present invention is driven by repeating the one frame operation.

As is described above, according to this embodiment, the data lines for the pixels 1 and 2 are selected and driven with one output from the current driver, and the pixels 1 and 2 are controlled by the different control lines. With this construction, the TFT 2 of the pixel 1 can continue to supply the current Idrv1 set in the driving period 1 to the light emitting element 122 of the pixel 1 without being influenced by variation in the gate voltage of the TFT 1 in the pixel 1 during the driving period 2. Thus, the brightness of the light emitting element in the pixel 1 stays unchanged, and display quality can be maintained.

Figure 9:
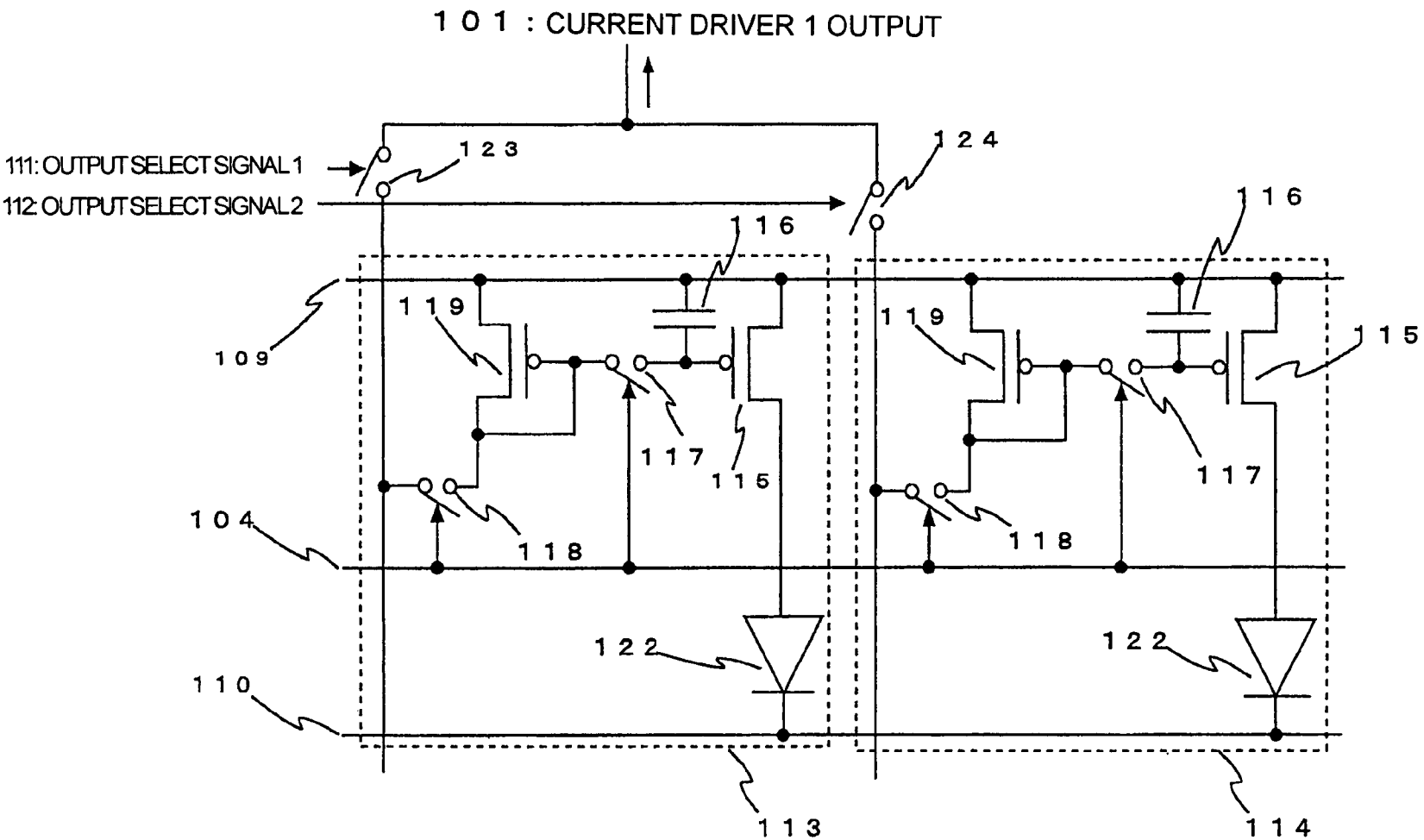
FIG. 9 is a diagram showing a circuitry as a comparative example.
Figure 10:
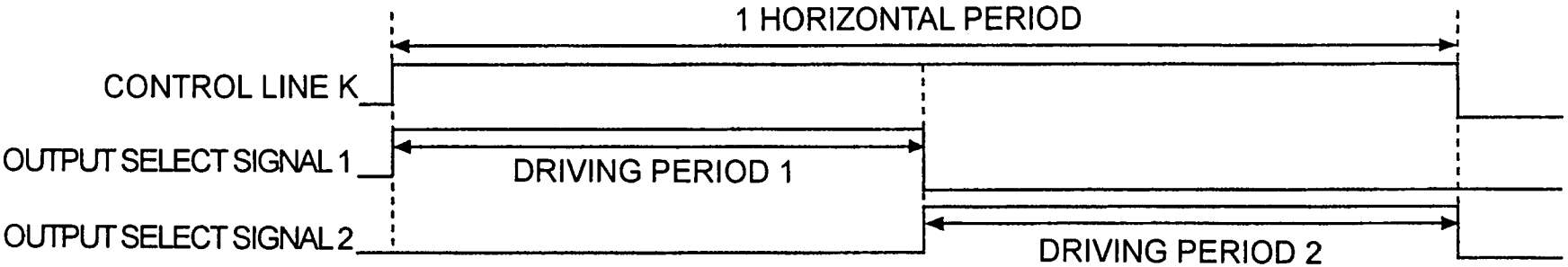
FIG. 10 is a timing chart showing the operation as a comparative example.

FIG. 9 is a diagram showing a circuitry presently adopted into a voltage write-type active matrix driving device, such as an LCD (Liquid Crystal Display), as a comparative example of the present invention. In FIG. 9, the control terminals of the switches SW 1 and SW 2 of the respective pixels 1 and 2 as shown in FIG. 5 are connected to the same control line. In this comparative example, the switches 117 and 118 of the pixels 1 and 2 are controlled to be on or off by a control signal 104 transmitted through a single control line 104. FIG. 10 is a timing chart showing the operation. The switches SW 1 and SW 2 of the pixels 1, especially the SW 2, are on during the driving period 2, and therefore, a variation in the gate voltage of the TFT 2 of the pixel 1 during the driving period 2 is reflected in the gate voltage of the TFT 1 of the pixel 1. Accordingly, the current set in the driving period 1 cannot be passed through the light emitting element of the pixel 1. For that reason, the brightness of the light emitting element in the pixel 1 varies, and display quality deteriorates.

Figure 11:
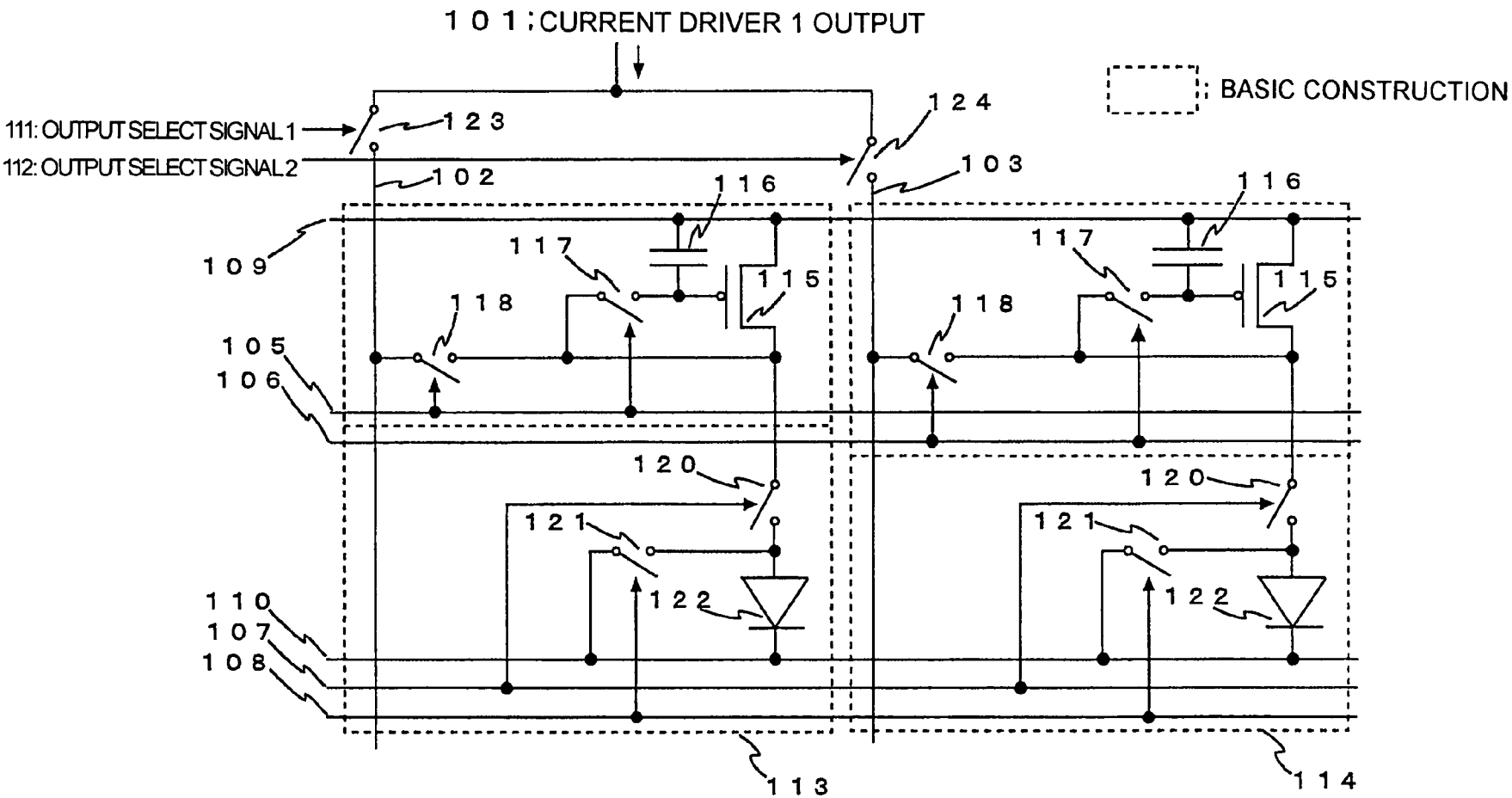
FIG. 11 is a diagram showing a circuitry according to a modified example of the first embodiment of the present invention.

The basic construction and operation of this embodiment may be applied to different light emitting element driving circuits than in the aforementioned Japanese Patent Application laid open No. HEI11-282419. For example, a light emitting element driving circuit as shown in FIG. 31 of the accompanying drawings of Japanese Patent Application No. 2001-259000 (undisclosed when the present application was filed) may be provided with the basic construction of this embodiment (first TFT 115, capacitance 116, first and second switches 117 and 118), in which the data line of either the pixel 1 or 2 can be selected with the output of the current driver. Referring to FIG. 11, a third switch 120 (SW 3) is placed between the drain of the first TFT 115 and one end (anode terminal) of the light emitting element 122, and a fourth switch 121 (SW 4) is placed between one end (anode terminal) of the light emitting element 122 and the ground line 110. The control terminals of the third and fourth switches 120 and 121 are connected to a third control line 107 (KC) and a fourth control line 108 (KD), respectively.

Figure 12:
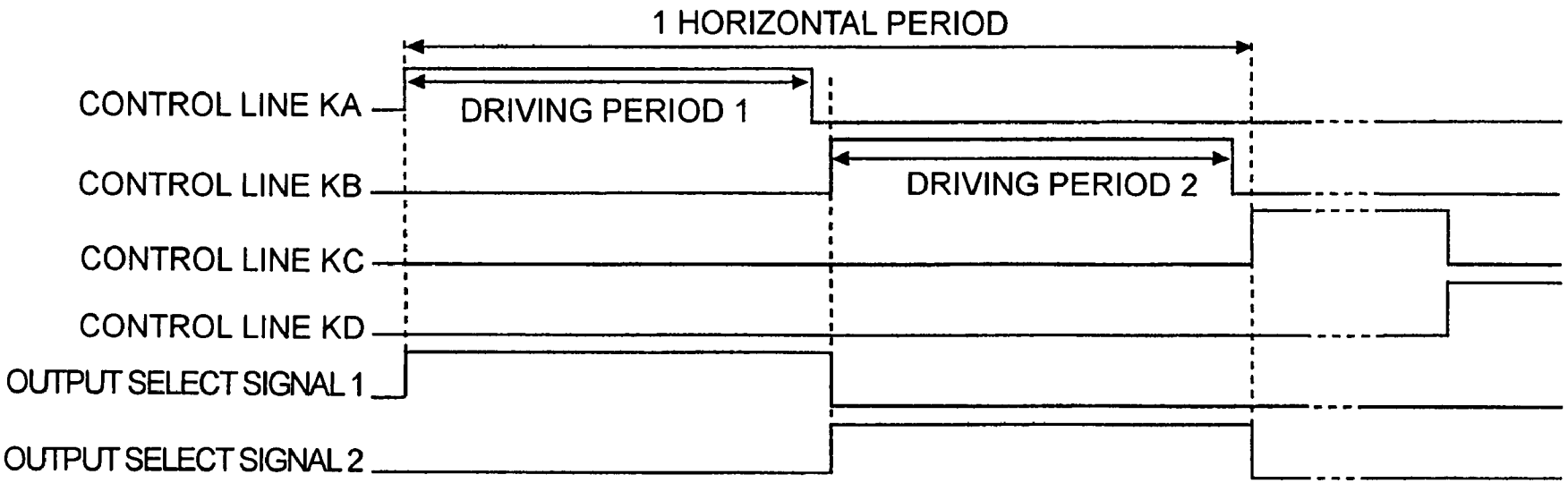
FIG. 12 is a timing chart showing the operation according to the modified example of the first embodiment of the present invention.

FIG. 12 is a timing chart showing the operation according to the modified example of the first embodiment illustrated in FIG. 11. When the control signal KC (107) transmitted through the control line KC (107) is at an H level, the switch SW 3 is on, and the light emitting element 122 is driven by the output current (drain current) from the TFT 115 so as to emit light. On the other hand, when the control signal KD (108) transmitted through the control line KC (108) is at an H level, the switch SW 4 is on, and one end of the light emitting element 122 is grounded. More specifically, referring to FIG. 12, during the driving period 1 in one horizontal period, the output select signal 1 and the control signal KA are at an H level, and the switch SW 1 and SW 2 of the pixel 1 are on. In the meanwhile, the switch SW 3 and SW 4 of the pixel 1 are in the off state, and the drain of the TFT 1 and the light emitting element 122 are not conducting. When the switch SW 1 and SW 2 of the pixel 1 are turned on, one end of the capacitance 116 in the pixel 1 is connected to the data line 1 via the switch SW 1 and SW 2 in the on state, and the terminal voltage of the capacitance 116 (gate voltage of the TFT 1) is set to a value corresponding to the current value of the current driver output 101. In the following driving period 2, the output select signal 2 is at an H level (the output select signal 1 is at an L level), the control signal KB is at an H level (the control signal KA is at an L level), and the switch SW 1 and SW 2 of the pixel 2 are on (the switch SW 1 and SW 2 of the pixel 1 are off). In the meanwhile, the switch SW 3 and SW 4 of the pixel 2 are in the off state, and the drain of the TFT 1 and the light emitting element 122 of the pixel 2 are not conducting. When the switch SW 1 and SW 2 of the pixel 2 are turned on, one end of the capacitance 116 in the pixel 2 is connected to the data line 2 via the switch SW 1 and SW 2 in the on state, and the terminal voltage of the capacitance 116 (gate voltage of the TFT 1) is set to a value corresponding to the current value of the current driver output 101. Subsequently, the output select signal 2 is brought to be at an L level (the control signals KA and KB are brought to be at an L level) while the control signal KC common to the pixels 1 and 2 is brought to be at an H level. As the switch SW 3 is turned on, the drain of the TFT 1 in the respective pixels 1 and 2 is connected to the light emitting element 122 via the switch 3 in the on state, and the light emitting element 122 is fed with the drain current of the TFT 1 (the value of the drain current of the TFT 1 depends on the terminal voltage of the capacitance 116). The light emitting element 122 in each of the pixels 1 and 2, which has been fed with the drain current according to the gate-source voltage of the TFT 1, emits light with brightness determined by the current. Thereafter, the control signal KC is brought to be at an L level while the control signal KD is brought to be at an H level, and one end of the light emitting element 122 is connected to the ground line 110. Thereby, the light emitting element 122 ceases to emit light. The period in which one end of the light emitting element 122 is connected to the ground line 110 is not restricted to the example shown in FIG. 12. The connection may be provided during a desired period set in advance.

According to this embodiment, the scale or size of the pixel is relatively conventional, however, the number of outputs from the current driver is reduced to a half of the number of all the data lines in the light emitting display device. Accordingly, the number of necessary current drivers is reduced by half. This leads to reductions in costs and the number of parts, and also the contact points between the current driver and the light emitting display device are reduced. Thus, it is possible to improve reliability and productivity.

Figure 13:
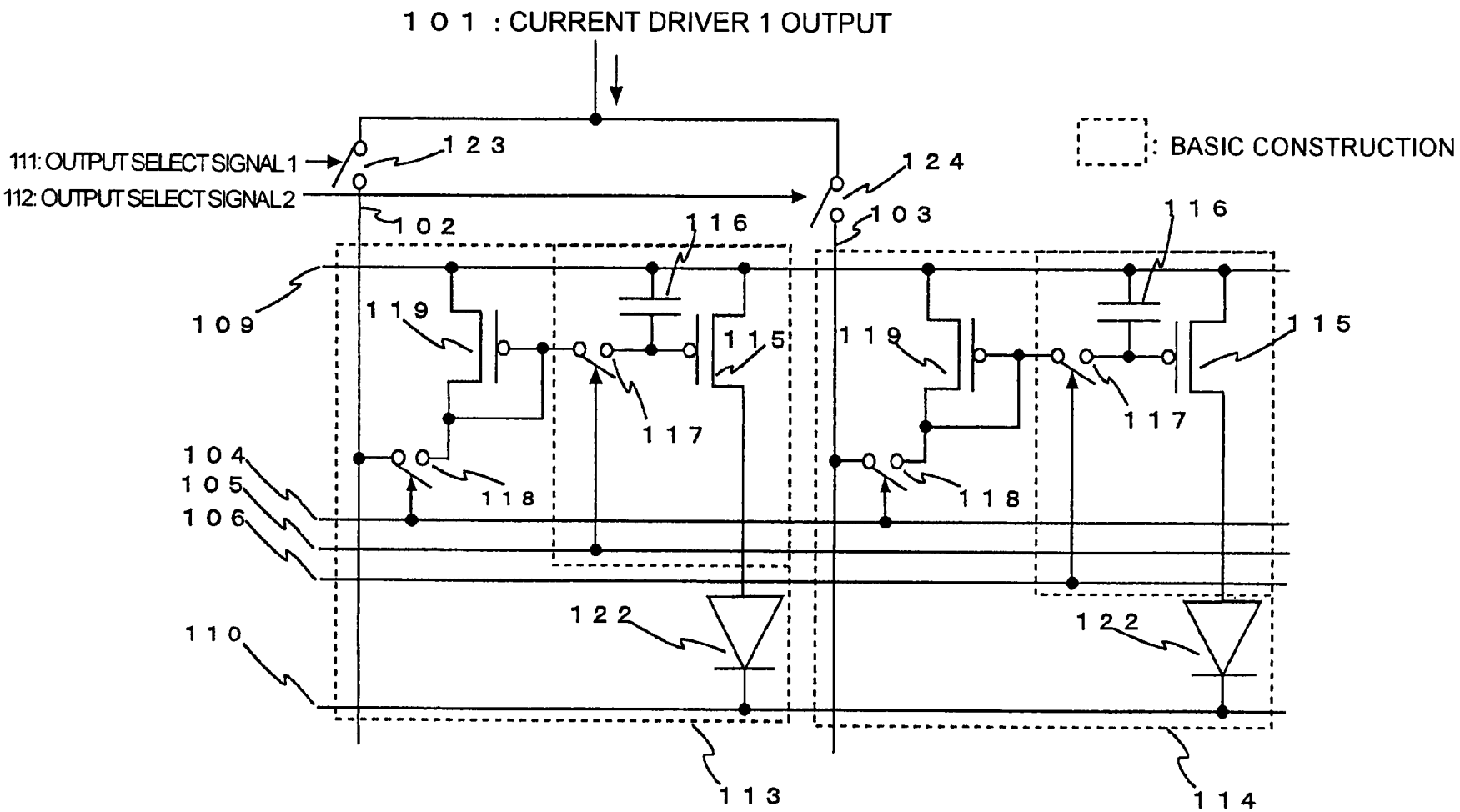
FIG. 13 is a diagram showing a circuitry according to the second embodiment of the present invention.

In the following, the second embodiment of the present invention will be described. Referring to FIG. 13, the first pixel 113 (pixel 1) comprises: the first TFT 115 (TFT 1) formed of polysilicon p-channel MOSFET, whose source is connected to the power supply line 109 and whose drain is connected to the light emitting element 122, for supplying current to the light emitting element 122; the capacitance 116 whose one end is connected to the gate of the first TFT 115 while the other end is connected to the power supply line 109; the first switch 117 (SW 1) connected between the gate of the second TFT 119 (TFT 2), whose source is connected to the power supply line 109 and whose gate and drain are connected to each other, and a contact node between the first TFT 115 and the capacitance 116; and the second switch 118 (SW 2) placed between the drain of the second TFT 119 and the first data line 102 (data line 1); wherein the control terminal of the first switch 117 is connected to the control line KA (105) for transmitting the control signal KA (105) while the second switch 118 is connected to the control line K (104) for transmitting the control signal K (104).

In the second pixel 114 (pixel 2), the drain of the second TFT 119 is connected to the second data line 103 (data line 2) through the second switch 118, and the control terminal of the first switch 117 is connected to the control line KB (106) for transmitting the control signal KB (106) while the second switch 118 is connected to the control line K (104) for transmitting the control signal K (104).

In accordance with this embodiment, as can be seen in FIG. 13, the two pixels are provided with the different control lines KA (105) and KB (106), respectively, for controlling the first switch SW 1 in the pixels, and the control line K (104) for controlling the second switch SW 2 in each driving circuit on the same line concurrently. Further, the pixels are provided with the switches 123 and 124 (SEL 1 and SEL 2) controlled by the first and second output select signals 1 and 2, respectively, for selecting either the data line 1 or the data line 2 to input one output of the current driver to each of the two pixels.

Figure 14:
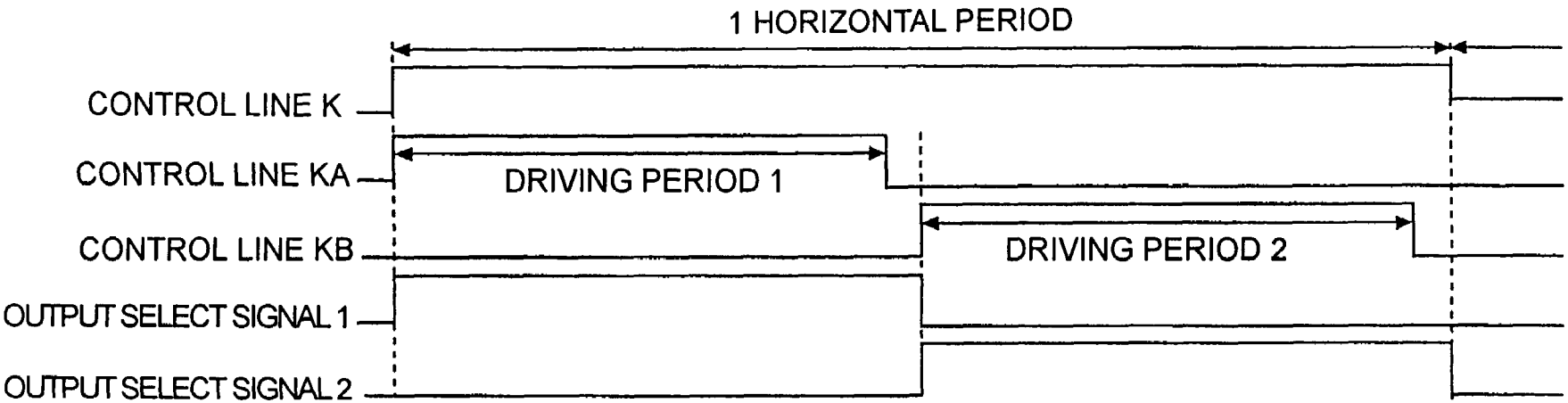
FIG. 14 is a timing chart showing the operation according to the second embodiment of the present invention.

FIG. 14 is a timing chart showing the operation according to this embodiment. One horizontal period is a period for supplying current to pixels in one line of a matrix of pixels and memorizing the current therein, during which the aforementioned SW 2 in every light emitting element driving circuit on the line is on.

In the driving period 1, the control signals K (104) and KA (105) and the output select signal 1 are at an H level while the control signal KB (106) and the output select signal 2 are at an L level, and the SW 2 of the pixel 2 as well as the SW 1, SW 2 and SEL 1 of the pixel 1 are on while the SW 1 and SEL 2 of the pixel 2 are off. Consequently, by the output of the current driver, current Id1 corresponding to the current to be supplied to the light emitting element of the pixel 1 through the TFT 1 of the pixel 1 is supplied via the data line and SW 1 of the pixel 1 to the TFT 2 of the pixel 1, which operates in the saturation region because the drain and the gate thereof are short-circuited. When the operation of the TFT 2 in the pixel 1 becomes stable, the gate-drain voltage of the TFT 2 in the pixel 1 is such voltage as to cause the flow of current Id1 through the TFT 2 of the pixel 1. This voltage is stored in the capacitance through the SW 2 of the pixel 1, and applied to the gate of the TFT 1 in the pixel 1. On this occasion, the gate-source voltage of the TFT 1 in the pixel 1 is determined, and current according to the voltage-current characteristics of the TFT 1 in the pixel 1 is supplied to the light emitting element of the pixel 1. Thereby, the light emitting element 122 of the pixel 1 emits light with brightness determined by the current.

At the end of the driving period 1, the control signal KA (105) is at an L level, and only the SW 1 of the pixel 1 is off. The other control signals remain the same as in the driving period 1. However, the output select signal 1 may mark an L level at the same time as the control signal KA (105). In this case, the SEL 1 is turned off at the same time as the switch SW 1 of the pixel 1.

During the driving period 2, the control signal KA (105) and the output select signal 1 are at an L level while the control signals K (104) and KB (106) and the output select signal 2 are at an H level, and the SW 1 and SEL 1 of the pixel 1 are off, and the SW 2 of the pixel 1 as well as the SW 1, SW 2 and SEL 2 of the pixel 2 are on. Consequently, in the pixel 2 during the driving period 2, by the output of the current driver, current Id2 corresponding to the current to be supplied to the light emitting element 122 of the pixel 2 through the TFT 1 of the pixel 2 is supplied via the data line and SW 1 of the pixel 2 to the TFT 2 of the pixel 2, which operates in the saturation region because the drain and the gate thereof are short-circuited, as in the case of the pixel 1 in the driving period 1. When the operation of the TFT 2 in the pixel 2 becomes stable, the gate/drain voltage of the TFT 2 in the pixel 2 is such voltage as to cause the flow of current Id2 through the TFT 2 of the pixel 2. This voltage is stored in the capacitance through the SW 2 of the pixel 2, and applied to the gate of the TFT 1 in the pixel 2. On this occasion, the gate-source voltage of the TFT 1 in the pixel 2 is determined, and current according to the voltage-current characteristics of the TFT 1 in the pixel 2 is supplied to the light emitting element of the pixel 2. Thereby, the light emitting element of the pixel 2 emits light with brightness determined by the current.

In the driving period 2, the SW 1 of the pixel 1 is off. At this time, since the gate and drain of the TFT 2 in the pixel 1 are short-circuited, a current flows between the drain and the source until the gate voltage of the TFT 2 becomes almost a threshold voltage of the TFT 2 as in the first embodiment. On the other hand, the gate voltage of the TFT 1 in the pixel 1 remains the voltage which has been determined in the driving period 1 because the SW 1 of the pixel 1 is off.

At the end of the driving period 2, as with the driving period 1, the control signal KB (106) is at an L level, and only the SW 1 of the pixel 2 has been changed to off. The other control signals remain the same as in the driving period 2.

Thereafter, the output select signal 2 and the control signal K (104) comes to an L level, and the SEL 1, the SW 2 of the pixel 1 and the SW 2 of the pixel 2 are turned off. However, the output select signal 2 and the control signal K (104) may mark an L level at the same time as the control signal KB (106). Whichever of the output select signal 2 or the control signal K (104) may come to an L level previously, they must be at an L level after or at the same time as the control signal KB (106).

The operation described above is performed in one horizontal period. When all the lines undergo such one horizontal period, the driving of one frame corresponding to one image plane or screen is completed. The light emitting display device of the present invention is driven by repeating the one frame operation.

According to this embodiment, as in the first embodiment described above, the data lines for the pixels 1 and 2 are selected and driven by one output from the current driver, and the pixels 1 and 2 are controlled by the different control lines. With this construction, the TFT 2 of the pixel 1 can continue to supply the current set in the driving period 1 to the light emitting element of the pixel 1 without being influenced by variation in the gate voltage of the TFT 1 in the pixel 1 during the driving period 2. Thus, the brightness of the light emitting element in the pixel 1 stays unchanged, and display quality can be maintained.

Besides, according to this embodiment, there is added another control line common to pixels on one line differently from the first embodiment, and the SW 2 is always on at the end of the driving periods 1 and 2. Consequently, the noise produced when the SW 2 is turned off at the time the SW 1 of each of the pixels 1 and 2 is turned off causes no effect. Thus, the operation can be more stable as compared to the first embodiment.

Figure 15:
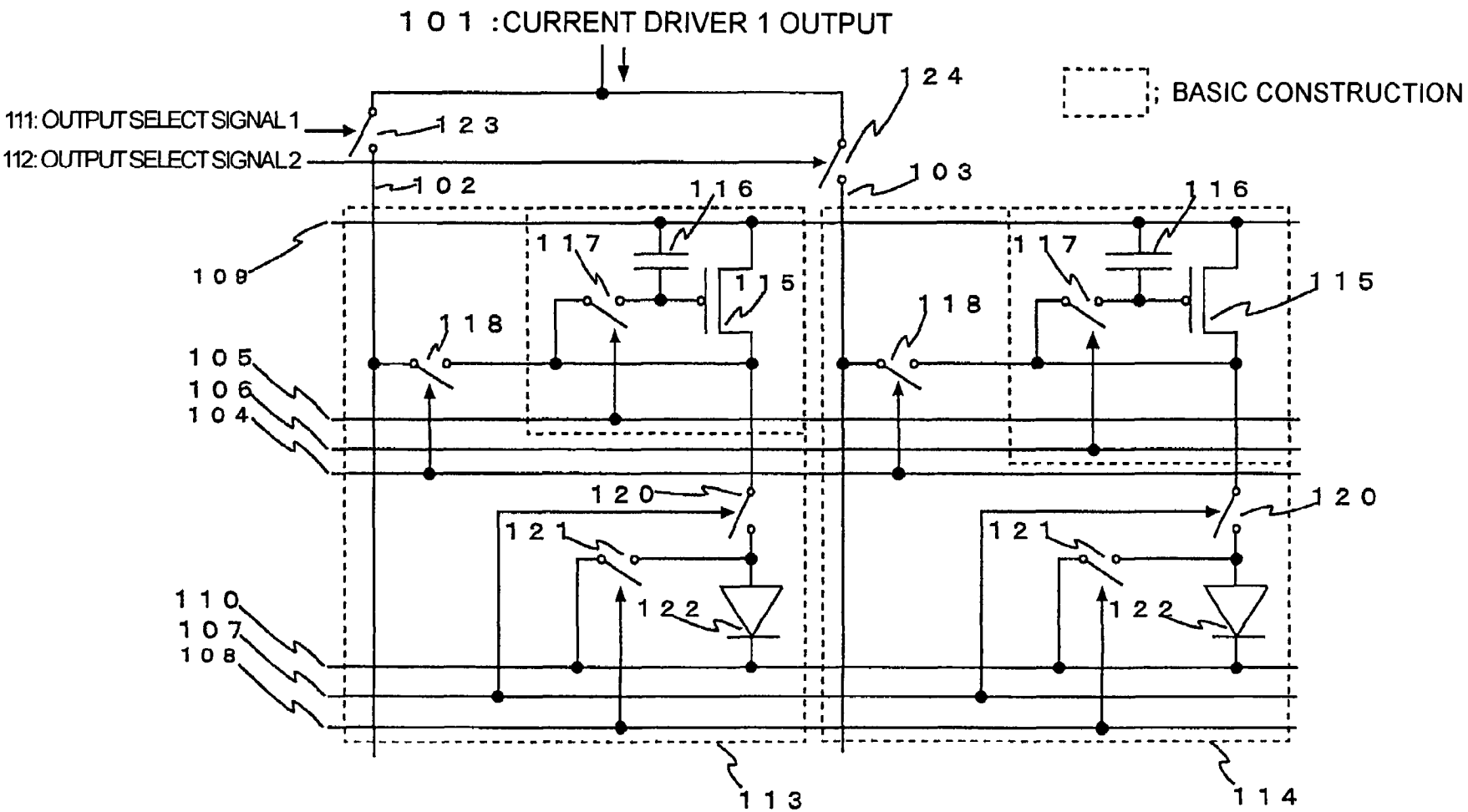
FIG. 15 is a diagram showing a circuitry according to a modified example of the second embodiment of the present invention.
Figure 16:
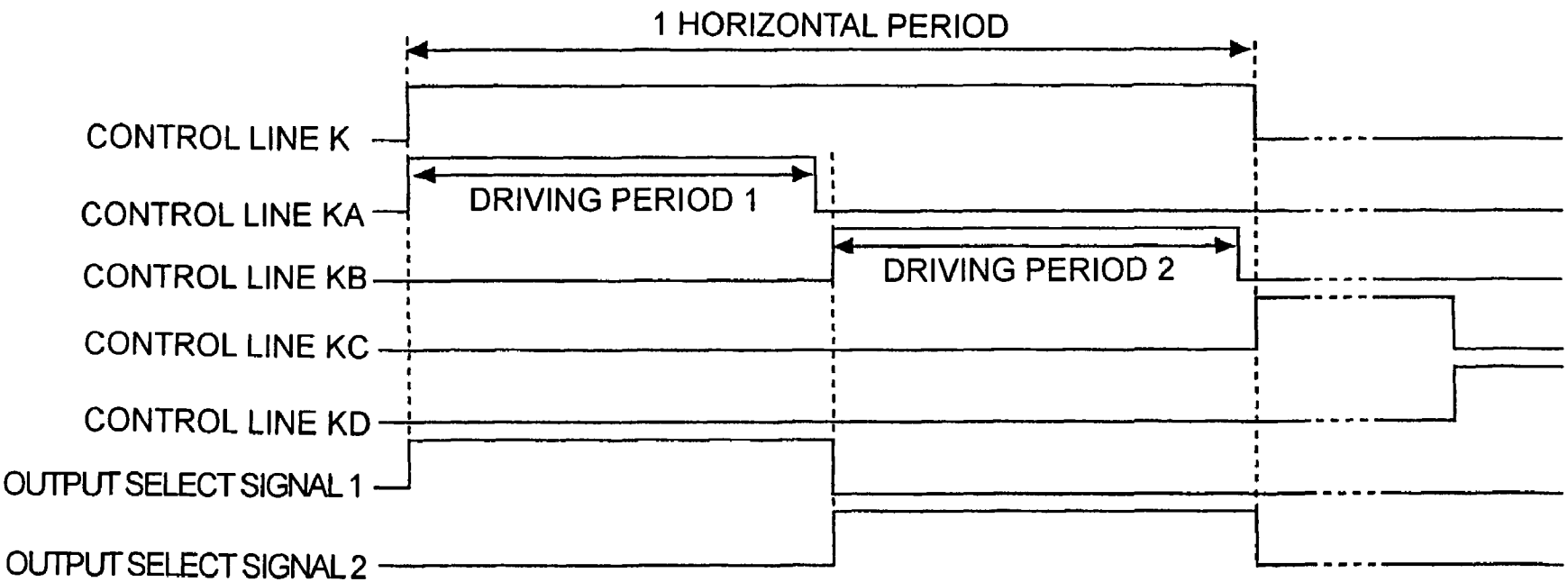
FIG. 16 is a timing chart showing the operation according to the modified example of the second embodiment of the present invention.

With regard to the basic construction and operation of this embodiment, for example, a light emitting element driving circuit disclosed in Japanese Patent Application No. 2001-259000 (FIG. 31) includes the basic construction of this embodiment (encircled by a dotted line), in which the data line of either the pixel 1 or 2 can be selected with respect to the output of the current driver as shown in FIG. 15. Referring to FIG. 15, each of the pixels 1 and 2 further comprises, in addition to the construction shown in FIG. 13, the third switch 120 (SW 3) placed between the drain of the first TFT 115 (TFT 1) and the anode of the light emitting element 122, and the fourth switch 121 (SW 4) placed between the anode of the light emitting element 122 and the ground line 110. The control terminals of the third and fourth switches 120 and 121 are connected to the third control line KC (107) and the fourth control line KD (108), respectively. FIG. 16 is a timing chart for explaining the operation of the device depicted in FIG. 15. When the control signal KC (107) transmitted through the control line KC (107) is at an H level, the switch SW 3 is on, and the light emitting element 122 is driven by the TFT 115. On the other hand, when the control signal KD (108) transmitted through the control line KC (108) is at an H level, the switch SW 4 is on, and the anode of the light emitting element 122 is grounded. ON/OFF control for the switches SW 3 and SW 4 is provided based on the control signals KC (107) and KD (108) in the same manner as described previously in connection with FIG. 12.

According to this embodiment, as in the first embodiment described above, the scale or size of the pixel is relatively conventional, however, the number of outputs from the current driver is reduced to a half of the number of all the data lines in the light emitting display device. Accordingly, the number of necessary current drivers is reduced by half. This leads to reductions in costs and the number of parts, and also the contact points between the current driver and the light emitting display device are reduced. Thus, it is possible to improve reliability and productivity.

The construction described in the above embodiments may be applicable with the same operation to the case where the current driver and the light emitting display device are formed on the same substrate. In this case, the number of outputs from the built-in current driver can be reduced by half as compared to the case where the construction of the present invention is not adopted, and the circuit scale or size can be reduced. For this reason, it is possible to increase the production yield as well as reducing costs. Besides, improvements in reliability and productivity can be achieved. Incidentally, the TFTs 1 and 2 are formed of pMOS transistors in the above-described embodiments, however, it is obvious that the TFTs may be formed of nMOS transistors. In this case, the source of the nMOS transistor TFT 1 (TFT 2) is connected to the ground line 110, the drain thereof is connected to one end (e.g. cathode terminal) of the light emitting element 122 directly or via the switch SW 3, and the other end (e.g. anode terminal) of the light emitting element 122 is connected to the power supply line 109. While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

INDUSTRIAL APPLICABILITY

As set forth hereinabove, in accordance with the present invention, there is provided a semiconductor device which comprises a matrix of current load cells each having a current load and a current load driving circuit, wherein a plurality of data lines are driven by one output of a current driver. Consequently, it is possible to reduce the number of current drivers as well as the number of necessary outputs from the current driver, which enables cost reductions.

Moreover, in accordance with the present invention, since the number of outputs from the current driver is reduced, the contact points between the current driver and the device can be reduced. Thus, it is possible to improve reliability and productivity.

Further, in accordance with the present invention, there is provided a semiconductor device which comprises a built-in current driver and a matrix of current loads and current load driving circuits, wherein a plurality of data lines are driven by one output of the current driver. Therefore, it is possible to reduce the number of necessary outputs from the current driver.

Still Further, in accordance with the present invention, since the scale of the built-in current driver is reduced, the yield increases and the circuit scale reduces. Thus, cost reductions can be achieved.

The invention claimed is:

1. A semiconductor device comprising:

a plurality of data lines running in one direction on a substrate;

a plurality of control lines running in a direction perpendicular to the data lines;

a plurality of current load cells each of which is set at the intersection of the respective data lines and control lines, and includes a current load and a current load driving circuit for driving the current load; and a selector having an input terminal to which one current output from a driver for current-driving the data lines is input, and a plurality of output terminals connected to the plural data lines, respectively; wherein:

the selector selects one of the plural data lines according to an output select signal input therein, and supplies the current output from the driver to the selected data line;

the plural data lines connected to the selector are connected to their corresponding current load cells, respectively;

the current load driving circuit in each of the current load cells includes:

a first MOS transistor whose source is connected to a first power supply while whose drain is connected to one end of the current load directly or via a third switch, the other end of the current load being connected to a second power supply;

a capacitance whose one end is connected to the gate of the first MOS transistor while whose the other end is connected to the first power supply or another power supply; and a first switch whose one end is connected to a contact node between the gate of the first MOS transistor and one end of the capacitance while whose the other end is connected to a corresponding data line directly or via a second switch;

there are control lines each transmitting a control signal corresponding to the first switch or the first and second switches of the current load driving circuit in each of the current load cells connected respectively to the data lines connected to the selector at least as many as data lines connected to the selector; and in each of the plural current load cells, the control signal corresponding to each of the current load cells is supplied to the control terminal of the first switch, or the control terminals of both the first and second switches of the current load driving circuit.

2. The semiconductor device claimed in claim 1, further comprising a second MOS transistor whose source is connected to the first power supply and whose gate and drain are connected to each other;

wherein the first switch is connected between the gate of the second MOS transistor and the contact node connecting the gate of the first MOS transistor with one end of the capacitance; and the second switch is placed between the drain of the second MOS transistor and a corresponding data line.

3. The semiconductor device claimed in claim 2, wherein the second MOS transistor is a TFT.

4. The semiconductor device claimed in claim 1, further comprising a fourth switch between one end of the current load and the second power supply.

5. The semiconductor device claimed in claim 1, wherein the first MOS transistor is a TFT.

6. The semiconductor device claimed in claim 1, wherein the current load is a light emitting element.

7. The semiconductor device claimed in claim 1, wherein the current driver and the semiconductor device are mounted on the same substrate.

8. The semiconductor device claimed in claim 1, wherein the current load is a light emitting element.

9. The semiconductor device claimed in claim 1, wherein the current load is an organic electro luminescence element.

10. A semiconductor device that performs active drive current programming, comprising: current load cells each having a current load and a current load driving circuit, which are arranged in a matrix; and a means for selecting a plurality of data lines one by one with respect to one current output from a current driver for supplying current to the respective data lines, and supplying the current output to the selected data line;

wherein the current load driving circuit in each of the current load cells includes:

a transistor whose source is connected to a first power supply while whose drain is connected to the current load directly or via a switch;

a capacitance connected between the gate of the transistor and the first power supply or another power supply; and a switch or a plurality of series-connected switches connected between the gate of the transistor and a corresponding data line; and wherein there are control lines for controlling the switch connected to the gate of the transistor included in each of the current load driving circuits at least as many as data lines selectable by one current output of the current driver in one line of the semiconductor device.

11. The semiconductor device claimed in claim 10, further comprising means for performing operations as follows during one horizontal period for selecting one line:

setting a voltage value corresponding to current from one output of the current driver in the gate of the transistor and one end of the capacitance in the current load cell by turning on one or more switches with a control signal transmitted through one of the plural control lines corresponding to the selected data line so that each current output of the current driver is electrically connected to the gate of the transistor in the current load cell during the period while one of the plural data lines is selected;

turning off the one or more switches before or upon completion of the period while one of the plural data lines is selected to maintain the setting voltage; and performing the above operations with respect to each of the plural data lines to complete current programming for the current load cells corresponding to one line.

12. The semiconductor device claimed in claim 10, wherein the current driver and the semiconductor device are mounted on the same substrate.

13. The semiconductor device claimed in claim 10, wherein the current load is a light emitting element.

14. The semiconductor device claimed in claim 10, wherein the current load is an organic electro luminescence element.

15. A semiconductor device that performs active drive current programming, comprising: current load cells each having a current load and a current load driving circuit, which are arranged in a matrix; and a means for selecting a plurality of data lines one by one with respect to one current output from a current driver for supplying current to the respective data lines, and supplying the current output to the selected data line;

wherein the current load driving circuit in each of the current load cells includes:

a transistor whose source is connected to a first power supply while whose drain is connected to the current load directly or via a switch;

a capacitance connected between the gate of the transistor and the first power supply or another power supply; and a plurality of switches connected in series between the gate of the transistor and a corresponding data line; and wherein there are control lines for controlling the switch connected to the gate of the transistor included in each of the current load driving circuits at least as many as data lines selectable by one current output of the current driver in one line of the semiconductor device; and there is a control line for controlling the switch whose one end is connected to the data line corresponding to the current load cell having the current load driving circuit in each line of the semiconductor device.

16. The semiconductor device claimed in claim 15, further comprising means for performing operations as follows during one horizontal period for selecting one line:

setting the respective switches whose one ends are connected to the data lines corresponding to all the current load cells for one line to the on state during one horizontal period with a control signal transmitted through the control line provided to each line;

setting a voltage value corresponding to current from one current output of the current driver in the gate of the transistor and one end of the capacitance in the current load cell by turning on one or more switches with a control signal transmitted through one of the plural control lines corresponding to the selected data line so that each current output of the current driver is electrically connected to the gate of the transistor in the current load cell during the period while one of the plural data lines is selected;

turning off the one or more switches before or upon completion of the period while one of the plural data lines is selected to maintain the setting voltage; and performing the above operations with respect to each of the plural data lines to complete current programming for the current load cells corresponding to one line.

17. A semiconductor device that performs active drive current programming, comprising: current load cells each having a current load and a current load driving circuit, which are arranged in a matrix; and a means for selecting a plurality of data lines one by one with respect to one current output from a current driver for supplying current to the respective data lines, and supplying the current output to the selected data line;

wherein the current load driving circuit in each of the current load cells includes: a means for outputting a voltage according to the current supplied from the current driver through the data line;

a means for maintaining the voltage;

a means for supplying current to the current load according to the voltage maintained; and a means for controlling functions of the current load of the driving circuit according to an input control signal; and wherein there are control lines for transmitting the control signal at least as many as data lines selectable by one current output of the current driver in one line of the semiconductor device.

18. A semiconductor device that performs active drive current programming, comprising: current load cells each having a current load and a current load driving circuit, which are arranged in a matrix; and a means for selecting a plurality of data lines one by one with respect to one current output from a current driver for supplying current to the respective data lines, and supplying the current output to the selected data line;

wherein the current load driving circuit in each of the current load cells includes at least:

a means for outputting a voltage according to the current supplied from the current driver through the data line;

a means for maintaining the voltage;

a means for supplying current to the current load according to the voltage maintained;

a means for controlling whether or not to maintain the voltage according to a first control signal input into the current load cell; and a means for controlling whether or not to establish a connection between the data line and the means for outputting the voltage according to a second control signal input into the current load cell; and wherein there are control lines for transmitting the first control signal at least as many as data lines selectable by one current output of the current driver in one line of the semiconductor device; and there is a control line for transmitting the second control signal in each line of the semiconductor device.

19. A semiconductor device driving method for driving a semiconductor device that performs active drive current programming and comprises current load cells each having a current load and a current load driving circuit, which are arranged in a matrix, wherein:

one current output of a current driver for current-driving data lines is input in a selector, the selector selects the plural data lines connected respectively to the outputs of the selector one by one based on an output select signal input therein, and the current output of the current driver is supplied to the selected data line;

the current load driving circuit in each of the current load cells includes:

a transistor whose source is connected to a first power supply while whose drain is connected to the current load directly or via a switch for supplying current to the current load;

a capacitance connected between the gate of the transistor and the first power supply or another power supply; and a switch or a plurality of series-connected switches connected between the gate of the transistor and a corresponding data line; and there are control lines for controlling the switch in the current load driving circuit at least as many as data lines selectable by one current output of the current driver in one line of the semiconductor device;

the semiconductor device driving method comprising, in one horizontal period for selecting one line:

a first step for passing current corresponding to the current output supplied from the current driver to the selected data line through the transistor in the current load cell by turning on the switch whose one end is connected to the gate of the transistor in the current load cell with a control signal transmitted through one of the plural control lines corresponding to the selected data line during the period while the selector selects one of the plural data lines based on the output select signal; and a second step for turning off the switch before or upon completion of the select period for the selected data line;

wherein the first and second steps are performed with respect to each of the plural data lines to complete current programming for the current load cells corresponding to one line.

20. A semiconductor device driving method for driving a semiconductor device that performs active drive current programming and comprises current load cells each having a current load and a current load driving circuit, which are arranged in a matrix, wherein:

one current output of a current driver for current-driving data lines is input in a selector, the selector selects the plural data lines connected respectively to the outputs of the selector one by one based on an output select signal input therein, and the current output of the current driver is supplied to the selected data line, the current load driving circuit in each of the current load cells includes:

a transistor whose source is connected to a first power supply while whose drain is connected to the current load directly or via a switch for memorizing and supplying current to the current load;

a capacitance connected between the gate of the transistor and the first power supply or another power supply; and a plurality of switches connected in series between the gate of the transistor and a corresponding data line;

there are control lines for controlling the switch whose one end is connected to the gate of the transistor included in the current load driving circuit at least as many as data lines selectable by one output of the current driver in one line of the semiconductor device; and there is a control line for controlling the switch whose one end is connected to the data line corresponding to the current load cell having the current load driving circuit in each line of the semiconductor device;

the semiconductor device driving method comprising, in one horizontal period for selecting one line:

a first step for setting the respective switches whose one ends are connected to the data lines corresponding to the current load cells for one line to the on state during one horizontal period with a control signal transmitted through the control line provided to each line;

a second step for passing current corresponding to the current output supplied from the current driver to the selected data line through the transistor in the current load cell by turning on the switch whose one end is connected to the gate of the transistor in the current load cell with a control signal transmitted through one of the plural control lines corresponding to the selected data line during the period while the selector selects one of the plural data lines based on the output select signal; and a third step for turning off the switch before or upon completion of the select period for the selected data line;

wherein the second and third steps are performed with respect to each of the plural data lines to complete current programming for the current load cells corresponding to one line.

21. A semiconductor device comprising:

a plurality of data lines running in one direction on a substrate;

a plurality of control lines running in a direction perpendicular to the data lines;

a plurality of current load cells each of which is set at the intersection of the respective data lines and control lines, and includes a current load and a current load driving circuit for driving the current load; and a selector having an input terminal to which one current output from a driver for current-driving the data lines is input, and a plurality of output terminals connected to the plural data lines, respectively; wherein:

the selector selects one of the plural data lines according to an output select signal input therein, and supplies the current output from the driver to the selected data line;

the plural data lines connected to the selector are connected to their corresponding current load cells, respectively;

the current load driving circuit in each of the current load cells includes:

a first MOS transistor whose source is connected to a first power supply while whose drain is connected to one end of the current load directly or via a third switch, the other end of the current load being connected to a second power supply;

a capacitance whose one end is connected to the gate of the first MOS transistor while whose the other end is connected to the first power supply or another power supply; and a first switch whose one end is connected to a contact node between the gate of the first MOS transistor and one end of the capacitance while whose the other end is connected to a corresponding data line via a second switch;

there are at least control lines each transmitting a control signal corresponding to the first switch of the current load driving circuit in each of the current load cells connected respectively to the data lines connected to the selector;

there is a control line for transmitting a common control signal corresponding to the second switch of the current load driving circuit in each of the current load cells;

the control signal corresponding to each of the current load cells is supplied to the control terminal of the first switch of the current load driving circuit in the current load cell; and the common control signal is supplied to the control terminal of the second switch of the current load driving circuit in the current load cell.

22. A semiconductor device driving method for driving a semiconductor device comprising:

a plurality of data lines running in one direction on a substrate;

a plurality of control lines running in a direction perpendicular to the data lines;

a plurality of current load cells each of which is set at the intersection of the respective data lines and control lines, and includes a current load and a current load driving circuit for driving the current load; and a selector having an input terminal to which one current output from a driver for current-driving the data lines is input, and a plurality of output terminals connected to the plural data lines, respectively; wherein:

the selector selects one of the plural data lines according to an output select signal input therein, and supplies the current output from the driver to the selected data line;

the plural data lines connected to the selector are connected to their corresponding current load cells, respectively;

the current load driving circuit in each of the current load cells includes:

a first MOS transistor whose source is connected to a first power supply while whose drain is connected to one end of the current load, the other end of the current load being connected to a second power supply;

a capacitance whose one end is connected to the gate of the first MOS transistor while whose the other end is connected to the first power supply or another power supply; and a first switch whose one end is connected to a contact node between the gate of the first MOS transistor and one end of the capacitance while whose the other end is connected to a corresponding data line directly or via a second switch;

there are control lines each transmitting a control signal corresponding to each of the current load cells connected respectively to the data lines connected to the selector; and in each of the plural current load cells, the control terminal of the first switch or the control terminals of both the first and second switches of the current load driving circuit are supplied with a control signal through the control line set correspondingly to each of the current load cells;

the semiconductor device driving method, wherein one cycle is divided into a number of driving periods corresponding to the plural current load cells connected respectively to the plural data lines connected to the driver via the selector, comprising the steps of:

(a) selecting one corresponding data line from the plural data lines by the selector based on the output select signal during each driving period corresponding to each of the plural current load cells;

(b) passing current corresponding to the current output supplied from the driver to the data line through the first MOS transistor in the current load cell by turning on the first switch or the first and second switches in the current load cell with a control signal transmitted through one of the control lines for the current load cell corresponding to the data line selected by the selector; and (c) turning off the first switch or the first and second switches in the current load cell with a control signal transmitted through the control line for the current load cell corresponding to the data line selected at step (a) before or at the time the selector proceeds to select the next data line based on the output select signal;

wherein the operating steps (a) and (b) are performed with respect to each of the plural data lines connected to the driver via the selector to complete current programming for the current load cells corresponding to one cycle.

23. The semiconductor device driving method claimed in claim 22 for driving the semiconductor device further comprising a second MOS transistor whose source is connected to the first power supply and whose gate and drain are connected to each other;

wherein the first switch is connected between the gate of the second MOS transistor and the contact node connecting the gate of the first MOS transistor with one end of the capacitance; and the second switch is placed between the drain of the second MOS transistor and a corresponding data line.

24. The semiconductor device driving method claimed in claim 22, wherein the current load is formed of a light emitting element, and one cycle is one horizontal period.

25. A semiconductor device driving method for driving a semiconductor device comprising:

a plurality of data lines running in one direction on a substrate;

a plurality of control lines running in a direction perpendicular to the data lines;

a plurality of current load cells each of which is set at the intersection of the respective data lines and control lines, and includes a current load and a current load driving circuit for driving the current load; and a selector having an input terminal to which one current output from a driver for current-driving the data lines is input, and a plurality of output terminals connected to the plural data lines, respectively; wherein:

the selector selects one of the plural data lines according to an output select signal input therein, and supplies the current output from the driver to the selected data line;

the plural data lines connected to the selector are connected to their corresponding current load cells, respectively;

the current load driving circuit in each of the current load cells includes:

a first MOS transistor whose source is connected to a first power supply while whose drain is connected to one end of the current load, the other end of the current load being connected to a second power supply;

a capacitance whose one end is connected to the gate of the first MOS transistor while whose the other end is connected to the first power supply or another power supply; and a first switch whose one end is connected to a contact node between the gate of the first MOS transistor and one end of the capacitance while whose the other end is connected to a corresponding data line via a second switch;

there are control lines each transmitting a control signal corresponding to the first switch of the current load driving circuit in each of the current load cells connected respectively to the data lines connected to the selector;

there is a common control line for transmitting a common control signal corresponding to the second switch of the current load driving circuit in each of the current load cells;

the control signal being individual to each of the current load cells is supplied to the control terminal of the first switch of the current load driving circuit in the current load cell; and the common control signal is supplied to the control terminal of the second switch of the current load driving circuit in the current load cell;

the semiconductor device driving method, wherein one cycle is divided into a number of driving periods corresponding to the plural current load cells connected respectively to the plural data lines connected to the driver via the selector, and the second switch in the current load cell is on during one cycle according to the common control signal, comprising the steps of:

(a) selecting one corresponding data line from the plural data lines by the selector based on the output select signal during each driving period corresponding to each of the plural current load cells;

(b) passing current corresponding to the current output supplied from the driver to the data line through the first MOS transistor in the current load cell by turning on the first switch in the current load cell with a control signal transmitted through one of the control lines for the current load cell corresponding to the data line selected by the selector; and (c) turning off the first switch with a control signal transmitted through the control line for the current load cell corresponding to the data line selected at step (a) before or at the time the selector proceeds to select the next data line based on the output select signal;

wherein the operating steps (a) and (b) are performed with respect to each of the plural data lines connected to the driver via the selector to complete current programming for the current load cells corresponding to one cycle.

26. A semiconductor device driving method for driving a semiconductor device comprising:

a plurality of data lines running in one direction on a substrate;

a plurality of control lines running in a direction perpendicular to the data lines;

a plurality of current load cells each of which is set at the intersection of the respective data lines and control lines, and includes a current load and a current load driving circuit for driving the current load; and a selector having an input terminal to which one current output from a driver for current-driving the data lines is input, and a plurality of output terminals connected to the plural data lines, respectively; wherein:

the selector selects one of the plural data lines according to an output select signal input therein, and supplies the current output from the driver to the selected data line;

the plural data lines connected to the selector are connected to their corresponding current load cells, respectively;

the current load driving circuit in each of the current load cells includes:

a first MOS transistor whose source is connected to a first power supply while whose drain is connected to one end of the current load via a switch (referred to as "third switch"), the other end of the current load being connected to a second power supply;

a capacitance whose one end is connected to the gate of the first MOS transistor while whose the other end is connected to the first power supply or another power supply; and a first switch whose one end is connected to a contact node between the gate of the first MOS transistor and one end of the capacitance while whose the other end is connected to a corresponding data line directly or via a second switch;

there are control lines each transmitting a control signal corresponding to each of the current load cells connected respectively to the data lines connected to the selector;

in each of the plural current load cells, the control terminal of the first switch of the current load driving circuit or the control terminals of both the first and second switches are supplied with the control signal through the control line corresponding to each of the current load cells;

a fourth switch is placed between a contact node connecting one end of the current load with the third switch and the second power supply; and there are a common control line connected to the control terminal of the third switch and a common control line connected to the control terminal of the fourth switch for the current load driving circuit in each of the current load cells connected respectively to the data lines connected to the selector;

the semiconductor device driving method, wherein one cycle is divided into a number of driving periods corresponding to the plural current load cells connected respectively to the plural data lines connected to the driver via the selector, comprising the steps of:

(a) selecting one corresponding data line from the plural data lines by the selector based on the output select signal during each driving period corresponding to each of the plural current load cells;

(b) turning on the first switch or the first and second switches in the current load cell with one of control signals for the current load cell corresponding to the data line selected by the selector, and setting the third switch to the off state with a control signal transmitted through the common control line so as to set the terminal voltage of the capacitance connected to the gate of the first MOS transistor to a voltage corresponding to the current output supplied from the driver to the data line;

(c) turning off the first switch or the first and second switches in the current load cell with a control signal for the current load cell corresponding to the data line selected at step (a) before or at the time the selector proceeds to select the next data line based on the output select signal; and (d) after the operating steps (a) and (b) are performed with respect to each of the plural data lines connected to the driver via the selector to set a current for the first MOS transistor of the respective current load cells corresponding to one cycle, turning on the third switch subsequently to the previous cycle so that the drain current of the first MOS transistor in the current load cell is supplied to the current load cell.

27. The semiconductor device driving method claimed in claim 26, wherein, at operating step (d), the period while the fourth switch is on is equal to or included in the period while the third switch is off.

28. A semiconductor device driving method for driving a semiconductor device comprising:

a plurality of data lines running in one direction on a substrate;

a plurality of control lines running in a direction perpendicular to the data lines;

a plurality of current load cells each of which is set at the intersection of the respective data lines and control lines, and includes a current load and a current load driving circuit for driving the current load; and a selector having an input terminal to which one current output from a driver for current-driving the data lines is input, and a plurality of output terminals connected to the plural data lines, respectively; wherein:

the selector selects one of the plural data lines according to an output select signal input therein, and supplies the current output from the driver to the selected data line;

the plural data lines connected to the selector are connected to their corresponding current load cells, respectively;

the current load driving circuit in each of the current load cells includes:

a first MOS transistor whose source is connected to a first power supply while whose drain is connected to one end of the current load via a switch (referred to as "third switch"), the other end of the current load being connected to a second power supply;

a capacitance whose one end is connected to the gate of the first MOS transistor while whose the other end is connected to the first power supply or another power supply; and a first switch whose one end is connected to a contact node between the gate of the first MOS transistor and one end of the capacitance while whose the other end is connected to a corresponding data line via a second switch;

there are control lines each transmitting a control signal corresponding to the first switch of the current load driving circuit in each of the current load cells connected respectively to the data lines connected to the selector;

there is a common control line corresponding to the second switch of the current load driving circuit in each of the current load cells;

the control terminal of the first switch of the current load driving circuit in the current load cell is supplied with the control signal through the control line corresponding to each of the current load cells;

the control terminal of the second switch of the current load driving circuit in the current load cell is supplied with a control signal through the common control line;

a fourth switch is placed between a contact node connecting one end of the current load with the third switch and the second power supply; and there are a common control line connected to the control terminal of the third switch and a common control line connected to the control terminal of the fourth switch for the current load driving circuit in each of the current load cells connected respectively to the data lines connected to the selector;

the semiconductor device driving method, wherein one cycle is divided into a number of driving periods corresponding to the plural current load cells connected respectively to the plural data lines connected to the driver via the selector, and the second switch in the current load cell is on while the third switch is off during one cycle according to the control signal transmitted through the common control line, comprising the steps of:

(a) selecting one corresponding data line from the plural data lines by the selector based on the output select signal during each driving period corresponding to each of the plural current load cells;

(b) turning on the first switch in the current load cell with one of control signals for the current load cell corresponding to the data line selected by the selector so as to set the terminal voltage of the capacitance connected to the gate of the first MOS transistor to a voltage corresponding to the current output supplied from the driver to the data line;

(c) turning off the first switch with a control signal for the current load cell corresponding to the data line selected at step (a) before or at the time the selector proceeds to select the next data line based on the output select signal; and (d) after the operating steps (a) and (b) are performed with respect to each of the plural data lines connected to the driver via the selector to set a current for the first MOS transistor of the respective current load cells corresponding to one cycle, turning on the third switch subsequently to the previous cycle so that the drain current of the first MOS transistor in the current load cell is supplied to the current load cell.

29. A semiconductor device comprising:

a plurality of data lines running in one direction;

a plurality of control lines running in a direction perpendicular to the data lines; and a matrix of current load cells each of which is set at the intersection of the respective data lines and control lines;

wherein each of the current load cells includes:

a current load; and a current load driving circuit for driving the current load, having:

a transistor connected in series with the current load between first and second power supplies;

a capacitance connected between the control terminal of the transistor and the first power supply; and at least one switch connected between the control terminal of the transistor and a corresponding data line; and wherein there are control lines for controlling the switch at least as many as data lines selectable by one current output of a current driver in one line of the semiconductor device; and one current output of the current driver is connected to the plural data lines via a selector, and the plural data lines connected to one current output of the current driver via the selector and at least one switch of each of the current load cells corresponding to the respective data lines are drive-controlled in a time division manner during one horizontal period.

* * * * *